US008378942B2

(12) United States Patent
Morita

(10) Patent No.: US 8,378,942 B2
(45) Date of Patent: Feb. 19, 2013

(54) SOURCE DRIVER, ELECTRO-OPTICAL DEVICE, PROJECTION-TYPE DISPLAY DEVICE, AND ELECTRONIC INSTRUMENT

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 1153 days.

(21) Appl. No.: 12/003,912

(22) Filed: Jan. 3, 2008

(65) Prior Publication Data

US 2008/0165212 A1 Jul. 10, 2008

(30) Foreign Application Priority Data

Jan. 10, 2007 (JP) ..... 2007-001984
Jun. 12, 2007 (JP) ..... 2007-154726
Dec. 19, 2007 (JP) ..... 2007-327191

(51) Int. Cl.
*G09G 3/36* (2006.01)

(52) U.S. Cl. ..... 345/89; 345/84; 345/204; 345/690

(58) Field of Classification Search ..... 345/87–100, 345/204, 690
See application file for complete search history.

(56) References Cited

U.S. PATENT DOCUMENTS 6,366,065 B1 4/2002 Morita
2002/0145408 A1 10/2002 Morita
2002/0145600 A1 10/2002 Morita
2005/0024242 A1* 2/2005 Koyama et al. ..... 341/100
2005/0040889 A1* 2/2005 Tsuchi ..... 330/255
2006/0033694 A1* 2/2006 Maki ..... 345/89
2006/0038764 A1 2/2006 Takahashi et al.
2006/0284806 A1* 12/2006 Maki ..... 345/89
2007/0063948 A1* 3/2007 Nishimura ..... 345/89

FOREIGN PATENT DOCUMENTS

JP A-02-130586 5/1990
JP A-7-306660 11/1995
JP A-11-064825 3/1999
JP A-11-239059 8/1999
JP A-2001-188615 7/2001
JP A-2002-164788 6/2002
JP A-2006-053252 2/2006
JP A-2006-058360 3/2006

* cited by examiner

*Primary Examiner* — Viet Pham
(74) *Attorney, Agent, or Firm* — Oliff & Berridge, PLC

(57) ABSTRACT

A source driver that drives a source line of an electro-optical device based on (j+k)-bit (j and k are natural numbers) grayscale data includes $2^j$ grayscale signal lines, a grayscale voltage select circuit that outputs two grayscale voltages among $2^j$ grayscale voltages supplied through the $2^j$ grayscale signal lines, and a source line driver circuit that outputs a grayscale voltage corresponding to lower-order k-bit data of the grayscale data from the source line driver circuit to the source line, the grayscale voltage output to the source line being a voltage among voltages between the low-potential-side grayscale voltage and the high-potential-side grayscale voltage output from the grayscale voltage select circuit to the source line driver circuit.

13 Claims, 19 Drawing Sheets

SOURCE DRIVER, ELECTRO-OPTICAL DEVICE, PROJECTION-TYPE DISPLAY DEVICE, AND ELECTRONIC INSTRUMENT

Japanese Patent Application No. 2007-001984 filed on Jan. 10, 2007, Japanese Patent Application No. 2007-154726 filed on Jun. 12, 2007, and Japanese Patent Application No. 2007-327191 filed on Dec. 19, 2007, are hereby incorporated by reference in their entirety.

BACKGROUND OF THE INVENTION

The present invention relates to a source driver, an electro-optical device, a projection-type display device, an electronic instrument, and the like.

As a liquid crystal panel (electro-optical device) used for electronic instruments such as a portable telephone or a projection-type display device, an active matrix type liquid crystal panel using a switching element such as a thin film transistor (hereinafter abbreviated as "TFT") have been known.

It has been considered to be difficult to reduce power consumption when using an active matrix type liquid crystal panel for portable electronic instruments such as a portable telephone. In recent years, power consumption can be sufficiently reduced using an active matrix type liquid crystal panel. An active matrix type liquid crystal panel has attracted attention due to its advantages (i.e., suitable for an increase in number of colors and motion picture display).

A drive signal of a display device is generally subjected to gamma correction corresponding to the grayscale characteristics of the display device in order to achieve high-definition image display. Taking a liquid crystal device as an example, a grayscale voltage which is gamma-corrected to achieve an optimum pixel transmissivity is output based on grayscale data for grayscale display. A source line is driven based on the resulting grayscale voltage.

In recent years, an increase in display image quality has been increasingly desired. Therefore, an increase in the number of grayscales has been desired for a source driver which drives a source line of an electro-optical device. In this case, it is necessary to supply a larger number of grayscale voltages to each output buffer which drives each source line of the electro-optical device.

When integrating a source driver on a semiconductor substrate, a configuration is generally employed in which a plurality of output buffers are arranged along the long side of a semiconductor substrate. Therefore, grayscale voltage signal lines are disposed to extend along the long side of the semiconductor substrate. Therefore, when increasing the number of grayscale voltage signal lines, the layout area (circuit scale) along the short side of the semiconductor substrate which intersects the long side of semiconductor substrate inevitably increases. For example, when the number of bits of grayscale data of each dot is six, the number of grayscale voltage signal lines is 64 ($=2^6$). When the number of bits of grayscale data is increased to eight, the number of grayscale voltage signal lines is increased to 256 ($=2^8$). As a result, the layout area of the grayscale voltage signal lines increases by four ($=2^{8-6}$).

JP-A-7-306660 discloses technology in which stepwise voltages are generated in order to reduce the number of grayscale voltage signal lines, and a pulse width modulation signal is generated by sampling a desired voltage from the stepwise voltages to achieve halftone representation. However, this technology has advantages in that grayscale representation is limited to the pulse-width modulation method, and it is difficult to increase the image quality when a larger number of grayscales is required.

It is also difficult to set the levels of the stepwise voltages with high accuracy. Even if the levels of the stepwise voltages can be set with high accuracy, the circuit becomes complicated. In particular, it becomes difficult to generate the stepwise voltages of which the levels are set with high accuracy, as disclosed in JP-A-7-306660, as the number of grayscales increases so that the difference in voltage between the grayscales decreases.

A high-definition image display is also desired for a projection-type display device. Although a reduction in power consumption is not desired for a source driver employed for a projection-type display device, a reduction in size of the source driver is particularly desired in order to reduce the circuit scale.

SUMMARY

According to one aspect of the invention, there is provided a source driver that drives a source line of an electro-optical device based on (j+k)-bit (j and k are natural numbers) grayscale data, the source driver comprising:

$2^j$ grayscale signal lines;

a grayscale voltage select circuit that outputs two grayscale voltages among $2^j$ grayscale voltages supplied through the $2^j$ grayscale signal lines; and a source line driver circuit that outputs a grayscale voltage corresponding to lower-order k-bit data of the grayscale data to the source line, the grayscale voltage output from the source line driver circuit to the source line being a voltage between the low-potential-side grayscale voltage and the high-potential-side grayscale voltage output from the grayscale voltage select circuit to the source line driver circuit.

According to another aspect of the invention, there is provided a source driver that drives a source line of an electro-optical device based on (j+k)-bit (j and k are natural numbers) grayscale data, the source driver comprising:

a grayscale voltage select circuit that outputs two adjacent grayscale voltages among $2^j$ grayscale voltages; and a source line driver circuit that outputs a grayscale voltage corresponding to lower-order k-bit data of the grayscale data to the source line, the grayscale voltage output from the source line driver circuit to the source line being a grayscale voltage among $2^k$ grayscale voltages between the two adjacent grayscale voltages from the grayscale voltage select circuit.

According to another aspect of the invention, there is provided an electro-optical device comprising one of the above source drivers.

According to another aspect of the invention, there is provided a projection-type display device comprising one of the above source drivers.

According to another aspect of the invention, there is provided an electronic instrument comprising one of the above source drivers.

DETAILED DESCRIPTION OF THE EMBODIMENT

Figure 1:
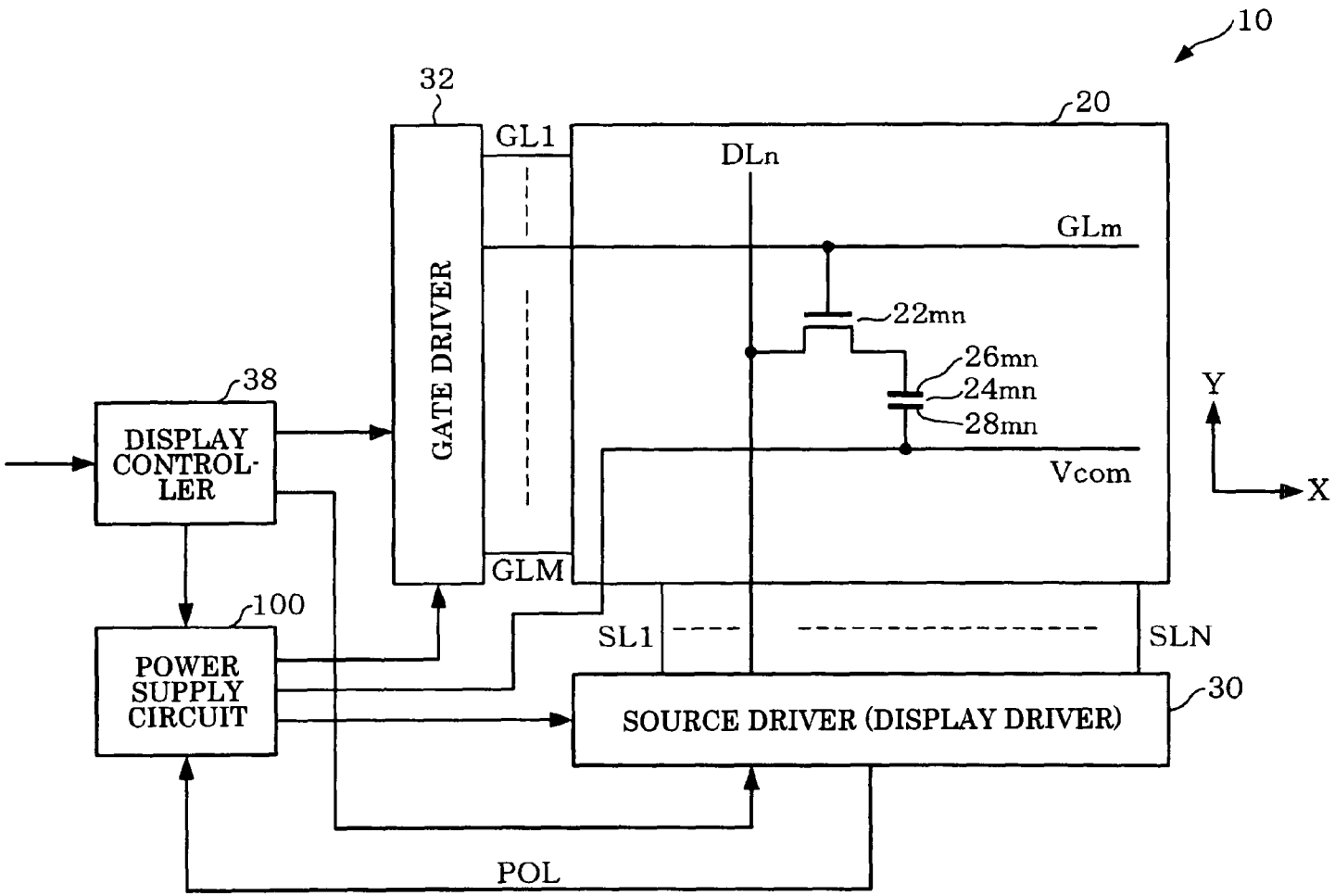
FIG. 1 is a view schematically showing the configuration of an active matrix type liquid crystal device according to one embodiment of the invention.

Some aspects of the invention may provide a source driver which can achieve high-definition image display without causing an increase in circuit scale, an electro-optical device, a projection-type display device, and an electronic instrument.

According to one embodiment of the invention, there is provided a source driver that drives a source line of an electro-optical device based on (j+k)-bit (j and k are natural numbers) grayscale data, the source driver comprising:

$2^j$ grayscale signal lines;

a grayscale voltage select circuit that outputs two grayscale voltages among $2^j$ grayscale voltages supplied through the $2^j$ grayscale signal lines; and a source line driver circuit that outputs a grayscale voltage corresponding to lower-order k-bit data of the grayscale data to the source line, the grayscale voltage output from the source line driver circuit to the source line being a voltage between the low-potential-side grayscale voltage and the high-potential-side grayscale voltage output from the grayscale voltage select circuit to the source line driver circuit.

According to this embodiment, since the number of grayscale signal lines can be reduced to a large extent, a source driver which can achieve high-definition image display without causing an increase in circuit scale can be provided.

In the source driver, the source line driver circuit may be a voltage follower circuit, the voltage follower circuit including a differential amplifier having a differential transistor pair, and a driver section driving the source line based on an output from the differential amplifier; and the source line driver circuit may output the grayscale voltage corresponding to the lower-order k-bit data of the grayscale data between the low-potential-side grayscale voltage and the high-potential-side grayscale voltage output from the source line driver circuit to the source line by changing a current drive capability of the differential transistor pair.

In the source driver, a second differential transistor group of first and second differential transistor groups may include k transistors, the first and second differential transistor groups forming the differential transistor pair; and a corresponding signal of one-bit data among the lower-order k-bit data of the grayscale data may be supplied to a gate of a corresponding transistor of the k transistors.

In the source driver, the source driver may comprise a lower-order bit decoder that decodes the lower-order k-bit data of the grayscale data, each of transistors of a second differential transistor group of first and second differential transistor groups may have an identical current drive capability, the first and second differential transistor groups forming the differential transistor pair; and a corresponding signal in accordance with a decoding result of the lower-order bit decoder may be supplied to a gate of a corresponding transistor of the transistors of the second differential transistor group.

According to this embodiment, a voltage between the low-potential-side grayscale voltage and the high-potential-side grayscale voltage from the grayscale voltage select circuit can be output based on the lower-order-bit data of the grayscale data by controlling the current drive capability of the differential transistor pair of the voltage follower circuit which forms the source line driver circuit. Therefore, a source driver which can achieve high-definition image display by a further simplified configuration without causing an increase in circuit scale can be provided.

In the source driver, the source driver may comprise a first grayscale select exception handling register, when the grayscale voltage select circuit outputs grayscale voltages that are allocated to voltages VSEL1 to VSEL ($2^k$) based on the lower-order k-bit data provided that the low-potential-side grayscale voltage is the voltage VSEL1 and the voltages VSEL1 to VSEL ($2^k$) are orderly allocated toward a high voltage side, the high-potential-side grayscale voltage may be allocated to the voltage VSEL ($2^k$) based on a value set in the first grayscale select exception handling register.

In the source driver, the source driver may comprise a second grayscale select exception handling register, when the high-potential-side grayscale voltage is allocated to the voltage VSEL ($2^k$) by the first grayscale select exception handling register, a highest-potential grayscale voltage among the $2^j$ grayscale voltages may be allocated to the high-potential-side grayscale voltage based on a value set in the second grayscale select exception handling register only when all bits of the grayscale data are "0" or only when all bits of the grayscale data are "1".

In the source driver, the source driver may comprise a first grayscale select exception handling register, when the grayscale voltage select circuit outputs grayscale voltages that are allocated to voltages VSEL1 to VSEL ($2^k$) based on the lower-order k-bit data provided that the high-potential-side grayscale voltage is the voltage VSEL1 and the voltages VSEL1 to VSEL ($2^k$) are orderly allocated toward a low voltage side, the low-potential-side grayscale voltage may be allocated to the voltage VSEL ($2^k$) based on a value set in the first grayscale select exception handling register.

In the source driver, the source driver may comprise a second grayscale select exception handling register, when the low-potential-side grayscale voltage is allocated to the voltage VSEL ($2^k$) by the first grayscale select exception handling register, a lowest-potential grayscale voltage among the $2^j$ grayscale voltages may be allocated to the low-potential-side grayscale voltage based on a value set in the second grayscale select exception handling register only when all bits of the grayscale data are "0" or only when all bits of the grayscale data are "1".

According to this embodiment, since the grayscale voltage allocation method accompanying a reduction in the number of grayscale signal lines can be changed as the exception handling process, an optimum grayscale representation corresponding to the grayscale characteristics of the electro-optical device can be implemented by a simple configuration.

According to another embodiment of the invention, there is provided a source driver that drives a source line of an electro-optical device based on (j+k)-bit (j and k are natural numbers) grayscale data, the source driver comprising:

a grayscale voltage select circuit that outputs two adjacent grayscale voltages among $2^j$ grayscale voltages; and a source line driver circuit that outputs a grayscale voltage corresponding to lower-order k-bit data of the grayscale data to the source line, the grayscale voltage output from the source line driver circuit to the source line being a grayscale voltage among $2^k$ grayscale voltages between the two adjacent grayscale voltages from the grayscale voltage select circuit.

According to another embodiment of the invention, there is provided an electro-optical device comprising:

a plurality of gate lines;

a plurality of source lines;

a plurality of pixels, each of the plurality of pixels being specified by a gate line among the plurality of gate lines and a source line among the plurality of source lines; and one of the above source drivers that drives the plurality of source lines.

The electro-optical device may further include a gate line driver that scans the plurality of gate lines.

According to another embodiment of the invention, there is provided an electro-optical device comprising one of the above source drivers.

According to this embodiment, an electro-optical device can be provided to which a source driver which can achieve high-definition image display without causing an increase in circuit scale is applied.

According to another embodiment of the invention, there is provided a projection-type display device comprising:

one of the above electro-optical devices;

a light source that emits light that enters the electro-optical device; and a projection device that projects light emitted from the electro-optical device.

According to another embodiment of the invention, there is provided a projection-type display device comprising one of the above source drivers.

According to this embodiment, a projection-type display device can be provided to which a source driver which can achieve high-definition image display without causing an increase in circuit scale is applied.

According to another embodiment of the invention, there is provided an electronic instrument comprising one of the above electro-optical devices.

According to another embodiment of the invention, there is provided an electronic instrument comprising:

one of the above electro-optical devices; and a device that supplies grayscale data to the electro-optical device.

According to another embodiment of the invention, there is provided an electronic instrument comprising one of the above source drivers.

According to this embodiment, an electronic instrument can be provided which includes a source driver which can achieve high-definition image display without causing an increase in circuit scale is applied.

Embodiments of the invention are described in detail below with reference to the drawings. Note that the embodiments described below do not in any way limit the scope of the invention laid out in the claims. Note that all elements of the embodiments described below should not necessarily be taken as essential requirements for the invention.

1. Liquid Crystal Device

FIG. 1 schematically shows the configuration of an active matrix type liquid crystal device according to this embodiment.

A liquid crystal device 10 includes a liquid crystal display (LCD) panel (display panel in a broad sense; electro-optical device in a broader sense) 20. The LCD panel 20 is formed on a glass substrate, for example. A plurality of gate lines (scan lines) GL1 to GLM (M is an integer equal to or larger than two), arranged in a direction Y and extending in a direction X, and a plurality of source lines (data lines) SL1 to SLN (N is an integer equal to or larger than two), arranged in the direction X and extending in the direction Y, are disposed on the glass substrate. A pixel region (pixel) is formed corresponding to the intersection of the gate line GLm ($1 \leqq m \leqq M$, m is an integer; hereinafter the same) and the source line SLn ($1 \leqq n \leqq N$, n is an integer; hereinafter the same). A thin film transistor (hereinafter abbreviated as "TFT") 22*mn* is disposed in the pixel region. An electro-optical device may include a device using a light-emitting element such as an organic electroluminescent (EL) element or an inorganic EL element.

The gate of the TFT 22*mn* is connected to the gate line GLm. The source of the TFT 22*mn* is connected to the source line SLn. The drain of the TFT 22*mn* is connected to a pixel electrode 26*mn*. A liquid crystal is sealed between the pixel electrode 26*mn* and a common electrode 28*mn* opposite to the pixel electrode 26*mn* so that a liquid crystal capacitor (element capacitor) (liquid crystal element in a broad sense) 24*mn* is formed. The transmissivity of a pixel changes depending on the voltage applied between the pixel electrode 26*mn* and the common electrode 28*mn*. A common electrode voltage Vcom is supplied to the common electrode 28*mn*. The term "element capacitor" may include a liquid crystal capacitor formed in a liquid crystal element or a capacitor formed in an EL element such as an inorganic EL element.

The LCD panel 20 is formed by bonding a first substrate provided with the pixel electrode and the TFT to a second substrate provided with the common electrode, and sealing a liquid crystal as an electro-optical material between the substrates, for example.

The liquid crystal device 10 includes a source driver (display driver in a broad sense; driver circuit in a broader sense) 30. The source driver 30 drives the source lines SL1 to SLN of the LCD panel 20 based on (j+k) (j and k are natural numbers) bit data.

The liquid crystal device 10 may include a gate driver (scan driver in a broad sense) 32. The gate driver 32 scans the gate lines GL1 to GLM of the LCD panel 20 within one vertical scan period.

The liquid crystal device 10 may include a power supply circuit 100. The power supply circuit 100 generates voltages necessary for driving the source lines, and supplies the generated voltages to the source driver 30. The power supply circuit 100 generates power supply voltages VDDH and VSSH necessary for the source driver 30 to drive the source lines and voltages necessary for a logic section of the source driver 30, for example.

The power supply circuit 100 also generates voltages necessary for scanning the gate lines, and supplies the generated voltages to the gate driver 32.

The power supply circuit 100 also generates the common electrode voltage Vcom. The power supply circuit 100 outputs the common electrode voltage Vcom to the common electrode of the LCD panel 20. The common electrode voltage Vcom is periodically set at a high-potential-side voltage VCOMH and a low-potential-side voltage VCOML in synchronization with the timing of a polarity inversion signal POL generated by the source driver 30. When color non-uniformity of the LCD panel 20 occurs due to a change in common electrode voltage Vcom, the power supply circuit 100 may output the common electrode voltage Vcom at a fixed voltage to the common electrode of the LCD panel 20.

The liquid crystal device 10 may include a display controller 38. The display controller 38 controls the source driver 30, the gate driver 32, and the power supply circuit 100 according to information set by a host (not shown) such as a central processing unit (hereinafter abbreviated as "CPU"). For example, the display controller 38 sets the operation mode of the source driver 30 and the gate driver 32, and supplies a vertical synchronization signal and a horizontal synchronization signal generated therein to the source driver 30 and the gate driver 32. The display controller 38 or the host may supply grayscale data to the source driver 30.

In FIG. 1, the liquid crystal device 10 is configured to include the power supply circuit 100 and the display controller 38. Note that at least one of the power supply circuit 100 and the display controller 38 may be provided outside the liquid crystal device 10. The liquid crystal device 10 may be configured to include the host.

The source driver 30 may include at least one of the gate driver 32 and the power supply circuit 100.

Figure 2:
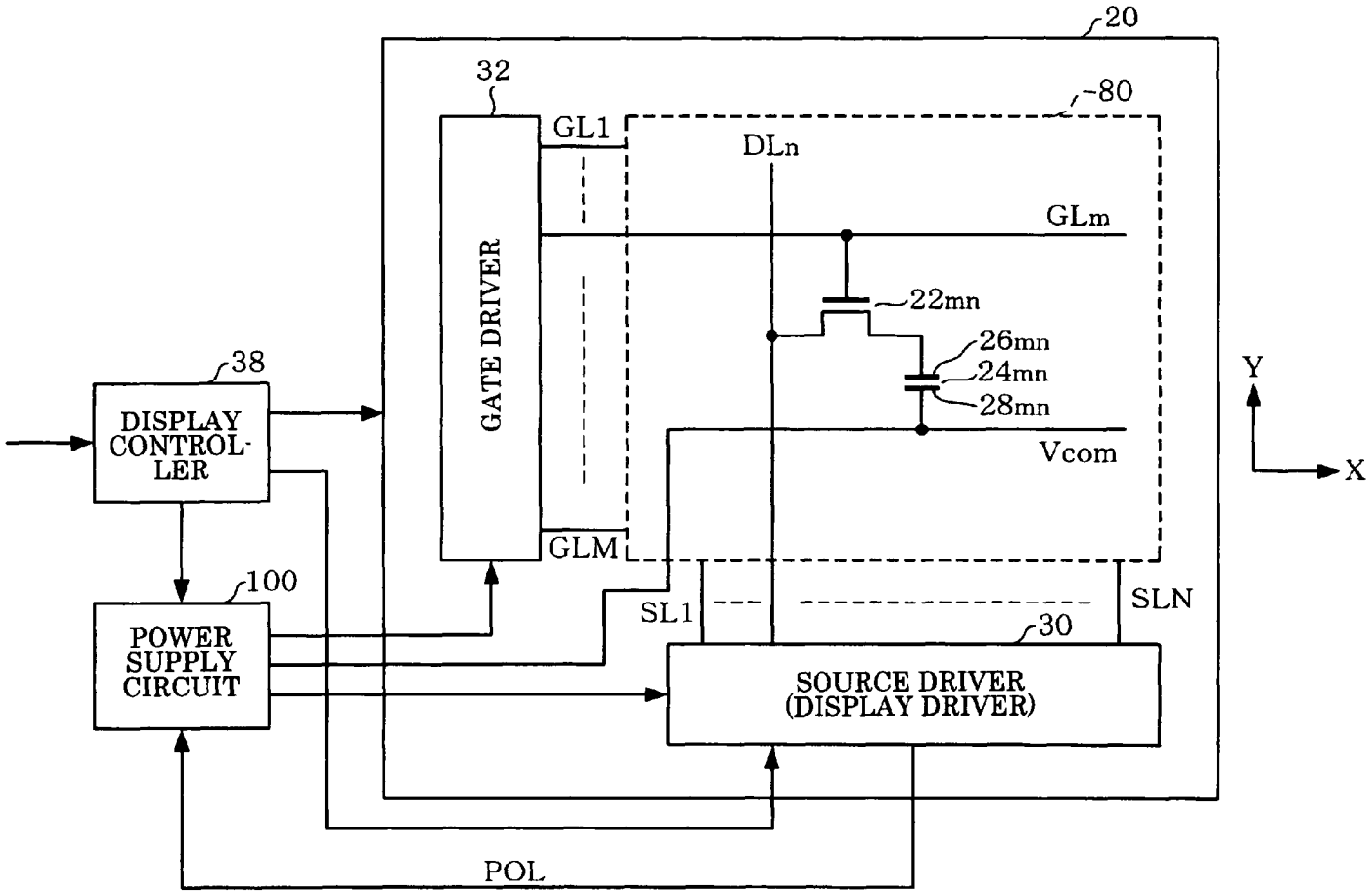
FIG. 2 is a view schematically showing another configuration of an active matrix type liquid crystal device according to one embodiment of the invention.

Some or all of the source driver 30, the gate driver 32, the display controller 38, and the power supply circuit 100 may be formed on the LCD panel 20. In FIG. 2, the source driver 30 and the gate driver 32 are formed on the LCD panel 20. Specifically, the LCD panel 20 may be configured to include a plurality of source lines, a plurality of gate lines, a plurality of switching elements, each of the plurality of switching elements being connected to a corresponding gate line among the plurality of gate lines and a corresponding source line among the plurality of source lines, and a display driver which drives the plurality of source lines. A plurality of pixels are formed in a pixel formation area 80 of the LCD panel 20.

1.1 Gate Driver

Figure 3:
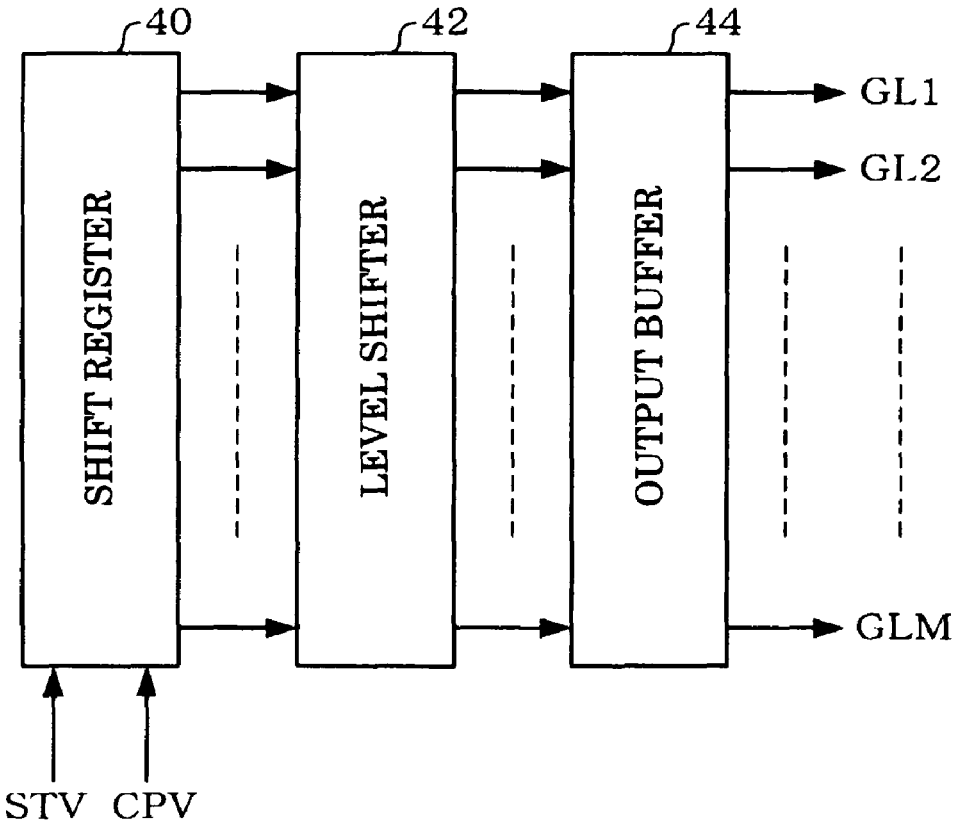
FIG. 3 is a block diagram showing a configuration example of a gate driver shown in FIG. 1 or 2.

FIG. 3 shows a configuration example of the gate driver 32 shown in FIG. 1 or 2.

The gate driver 32 includes a shift register 40, a level shifter 42, and an output buffer 44.

The shift register 40 includes a plurality of flip-flops provided corresponding to the respective gate lines and sequentially connected. The shift register 40 holds a start pulse signal STV in the flip-flop in synchronization with a clock signal CPV, and sequentially shifts the start pulse signal STV to the adjacent flip-flops in synchronization with the clock signal CPV. The clock signal CPV is a horizontal synchronization signal, and the start pulse signal STV is a vertical synchronization signal.

The level shifter 42 shifts the level of the voltage input from the shift register 40 to a voltage level corresponding to the liquid crystal element of the LCD panel 20 and the transistor capability of the TFT. A high voltage level of 20 to 50 V is required as the above voltage level, for example.

The output buffer 44 buffers the scan voltage shifted by the level shifter 42, and drives the gate line by outputting the scan voltage to the gate line.

1.2 Source Driver

Figure 4:
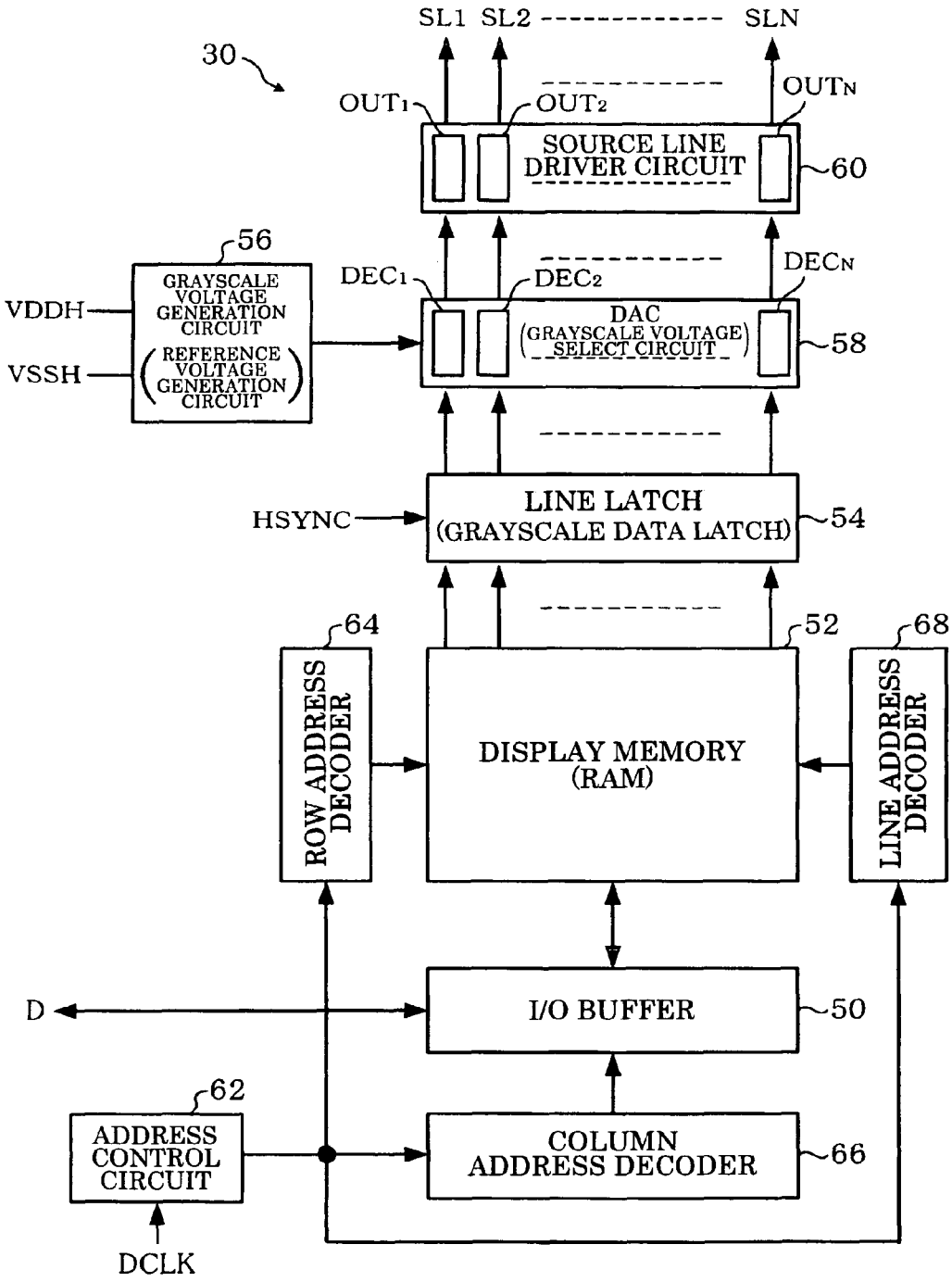
FIG. 4 is a block diagram showing a configuration example of a source driver shown in FIG. 1 or 2.

FIG. 4 is a block diagram showing a configuration example of the source driver 30 shown in FIG. 1 or 2.

The source driver 30 includes an I/O buffer 50, a display memory 52, a line latch 54, a grayscale voltage generation circuit 56, a digital/analog converter (DAC) 58 (grayscale voltage select circuit in a broad sense), and a source line driver circuit 60.

Grayscale data D is input to the source driver 30 from the display controller 38, for example. The grayscale data D is input in synchronization with a dot clock signal DCLK, and is buffered by the I/O buffer 50. The dot clock signal DCLK is supplied from the display controller 38.

The I/O buffer 50 is accessed from the display controller 38 or the host (not shown). The grayscale data buffered by the I/O buffer 50 is written into the display memory 52. The grayscale data read from the display memory 52 is buffered by the I/O buffer 50, and is output to the display controller 38 and the like.

The display memory 52 (grayscale data memory) includes memory cells respectively provided corresponding to output lines connected with the source lines. Each memory cell is specified by a row address and a column address. The memory cells of one scan line are specified by a line address.

An address control circuit 62 generates the row address, the column address, and the line address for specifying a memory cell in the display memory 52. The address control circuit 62 generates the row address and the column address when writing the grayscale data into the display memory 52. Specifically, the grayscale data buffered by the I/O buffer 50 is written into the memory cell of the display memory 52 specified by the row address and the column address.

A row address decoder 64 decodes the row address, and selects the memory cells of the display memory 52 corresponding to the row address. A column address decoder 66 decodes the column address, and selects the memory cells of the display memory 52 corresponding to the column address.

The address control circuit 62 generates the line address when reading the grayscale data from the display memory 52 and outputting the grayscale data to the line latch 54. Specifically, a line address decoder 68 decodes the line address, and selects the memory cells of the display memory 52 corresponding to the line address. The grayscale data of one horizontal scan read from the memory cells specified by the line address is output to the line latch 54.

The address control circuit 62 generates the row address and the column address when reading the grayscale data from the display memory 52 and outputting the grayscale data to the I/O buffer 50. Specifically, the grayscale data held by the memory cell of the display memory 52 specified by the row address and the column address is read into the I/O buffer 50. The grayscale data read into the I/O buffer 50 is acquired by the display controller 38 or the host (not shown).

Therefore, the row address decoder 64, the column address decoder 66, and the address control circuit 62 shown in FIG. 4 function as a write control circuit which controls writing of the grayscale data into the display memory 52. The line address decoder 68, the column address decoder 66, and the address control circuit 62 shown in FIG. 4 function as a read control circuit which controls reading of the grayscale data from the display memory 52.

The line latch 54 latches the grayscale data of one horizontal scan read from the display memory 52 at a change timing of a horizontal synchronization signal HSYNC. The line latch 54 includes registers, each of which holds the grayscale data corresponding to one dot. The grayscale data corresponding to one dot read from the display memory 52 is written into each register of the line latch 54.

The grayscale voltage generation circuit (reference voltage generation circuit in a broad sense) 56 generates a plurality of grayscale voltages (reference voltages) respectively corresponding to the grayscale data. Specifically, the grayscale voltage generation circuit 56 generates the grayscale voltages which respectively correspond to pieces of grayscale data based on a high-potential-side power supply voltage VDDH and a low-potential-side power supply voltage VSSH. More specifically, the grayscale voltage generation circuit 56 generates $2^j$ grayscale voltages based on higher-order j-bit data contained in (j+k)-bit grayscale data. The source driver 30 includes $2^j$ grayscale signal lines. The $2^j$ grayscale voltages are respectively supplied to the grayscale signal lines. The grayscale voltage generation circuit 56 simultaneously outputs the $2^j$ grayscale voltages among the voltages of division nodes of a resistor circuit to which the high-potential-side power supply voltage VDDH and the low-potential-side power supply voltage VSSH are supplied at either end.

The DAC 58 generates a grayscale voltage corresponding to the grayscale data (i.e., higher-order j-bit data of the grayscale data) output from the line latch 54 in units of output lines (i.e., outputs of the source line driver circuit 60). Specifically, the DAC 58 selects the grayscale voltage corresponding to the grayscale data (i.e., higher-order j-bit data of the grayscale data) corresponding to one output line of the source line driver circuit 60 output from the line latch 54 from the grayscale voltages generated by the grayscale voltage generation circuit 56, and outputs the selected grayscale voltage.

The DAC 58 includes voltage select circuits $DEC_1$ to $DEC_N$ provided in output line units. Each voltage select circuit outputs a grayscale voltage corresponding to the grayscale data from the grayscale voltages output from the grayscale voltage generation circuit 56.

The source line driver circuit 60 drives a plurality of output lines respectively connected to the source lines of the LCD panel 20. Specifically, the source line driver circuit 60 drives the output lines based on the grayscale voltages output from voltage select circuits of the DAC 58 in output line units. The source line driver circuit 60 includes output circuits $OUT_1$ to $OUT_N$ provided in output line units. Each output circuit drives the source line based on the grayscale voltage from the corresponding voltage select circuit. Each output circuit is a voltage follower circuit. The voltage follower circuit may be formed using a voltage-follower-connected operational amplifier and the like.

Figure 5:
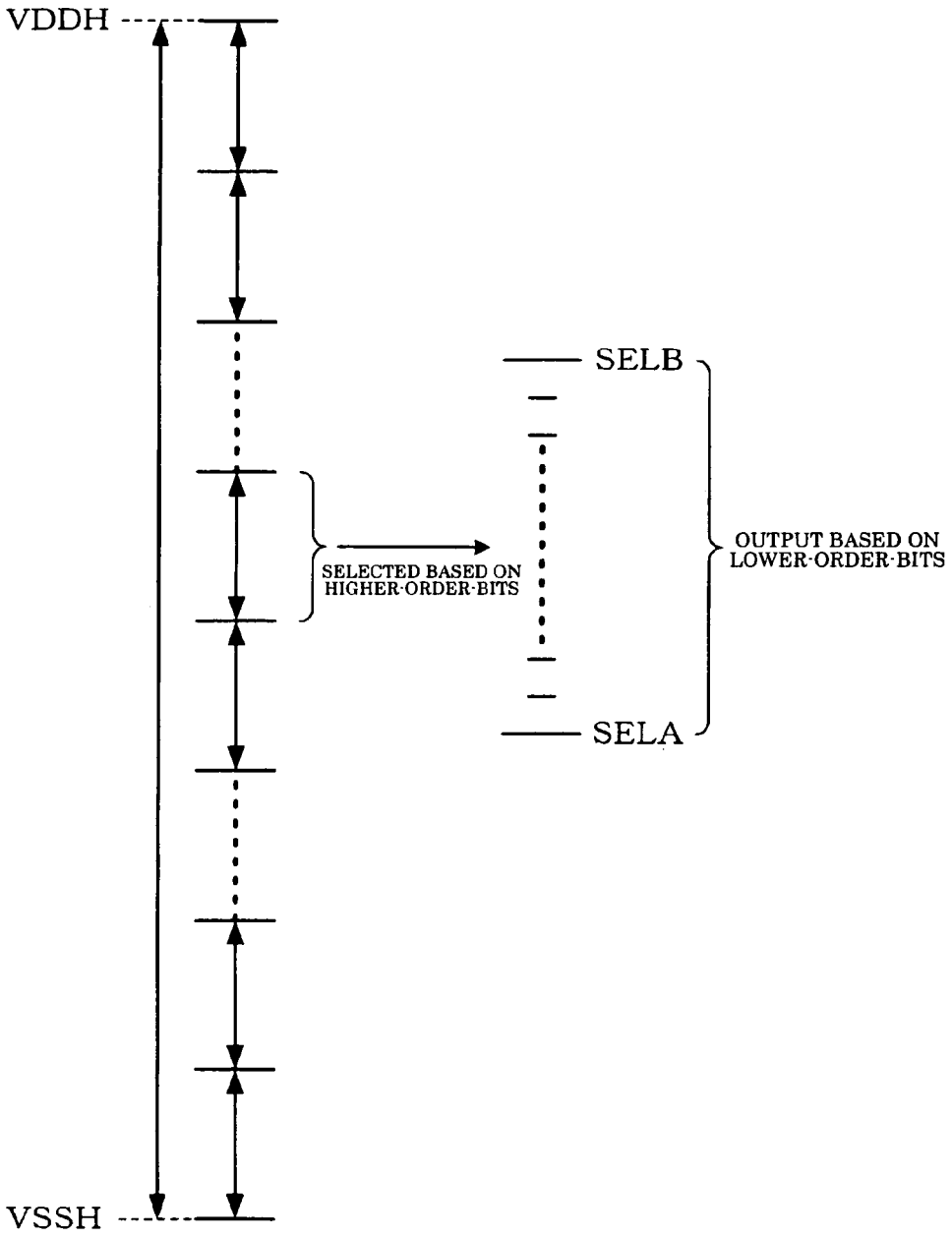
FIG. 5 is a view illustrative of the operation of a source driver according to one embodiment of the invention.

FIG. 5 is a view illustrative of the operation of the source driver according to this embodiment.

In this embodiment, each voltage select circuit of the DAC 58 selects two voltages SELA and SELB between the high-potential-side power supply voltage VDDH and the low-potential-side power supply voltage VSSH among $2^{(j+k)}$ grayscale voltages which can be supplied from the source driver 30 to each source line based on the higher-order j-bit data of the grayscale data. Each output circuit of the source line driver circuit 60 then outputs a voltage between the voltages SELA and SELB selected by each voltage select circuit based on the lower-order k-bit data of the grayscale data.

Figure 6:
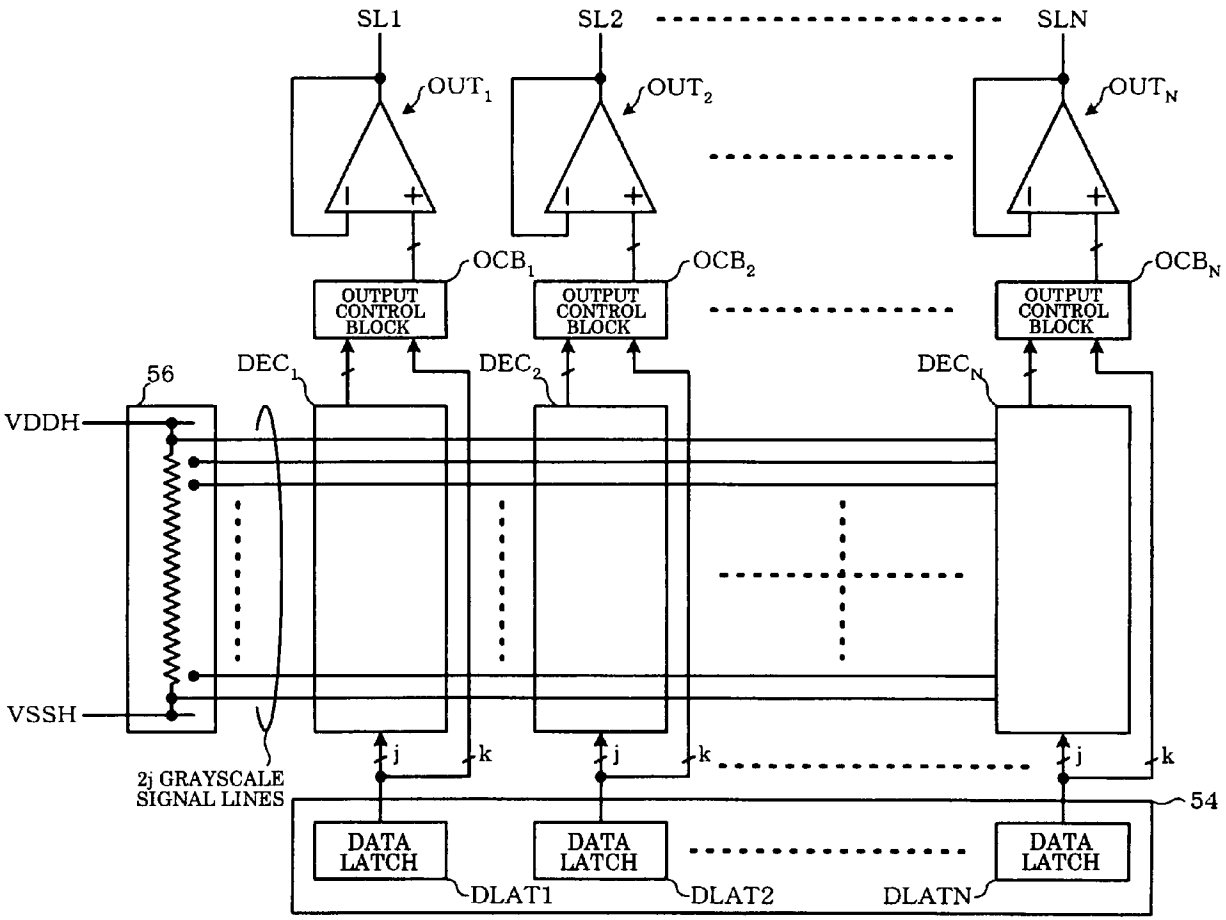
FIG. 6 is a view showing a configuration example of the major portion of a source driver according to one embodiment of the invention.

FIG. 6 shows a configuration example of the main portion of the source driver according to this embodiment.

FIG. 6 shows the line latch 54, the grayscale voltage generation circuit 56, the DAC 58, and the source line driver circuit 60 included in the source driver 30 shown in FIG. 4.

The line latch 54 has provided data latches DLAT1 to DLATN provided in output destination units. Each of the data latches DLAT1 to DLATN latches (j+k)-bit grayscale data corresponding to one dot.

The $2^j$ grayscale signal lines are provided so that $2^j$ grayscale voltages are supplied to the voltage select circuits $DEC_1$ to $DEC_N$. Each voltage select circuit outputs the low-potential-side voltage SELA and the high-potential-side voltage SELB which specify an interval corresponding to the higher-order j-bit data of the grayscale data.

The source driver 30 includes output control blocks $OCB_1$ to $OCB_N$ provided in output line units. The output control blocks $OCB_1$ to $OCB_N$ have an identical configuration. Each of the output control blocks $OCB_1$ to $OCB_N$ outputs a control signal for a voltage follower circuit included in the corresponding output circuit. Specifically, each output control block outputs the control signal which controls the corresponding output circuit based on the voltage SELA or SELB from the corresponding voltage select circuit. In FIG. 6, each output control block outputs the control signal corresponding to the lower-order k-bit data of the grayscale data. The voltage level of the control signal is the voltage SELA or SELB. The output circuit outputs a voltage between the voltages SELA and SELB based on the control signal from the output control block.

Figure 7:
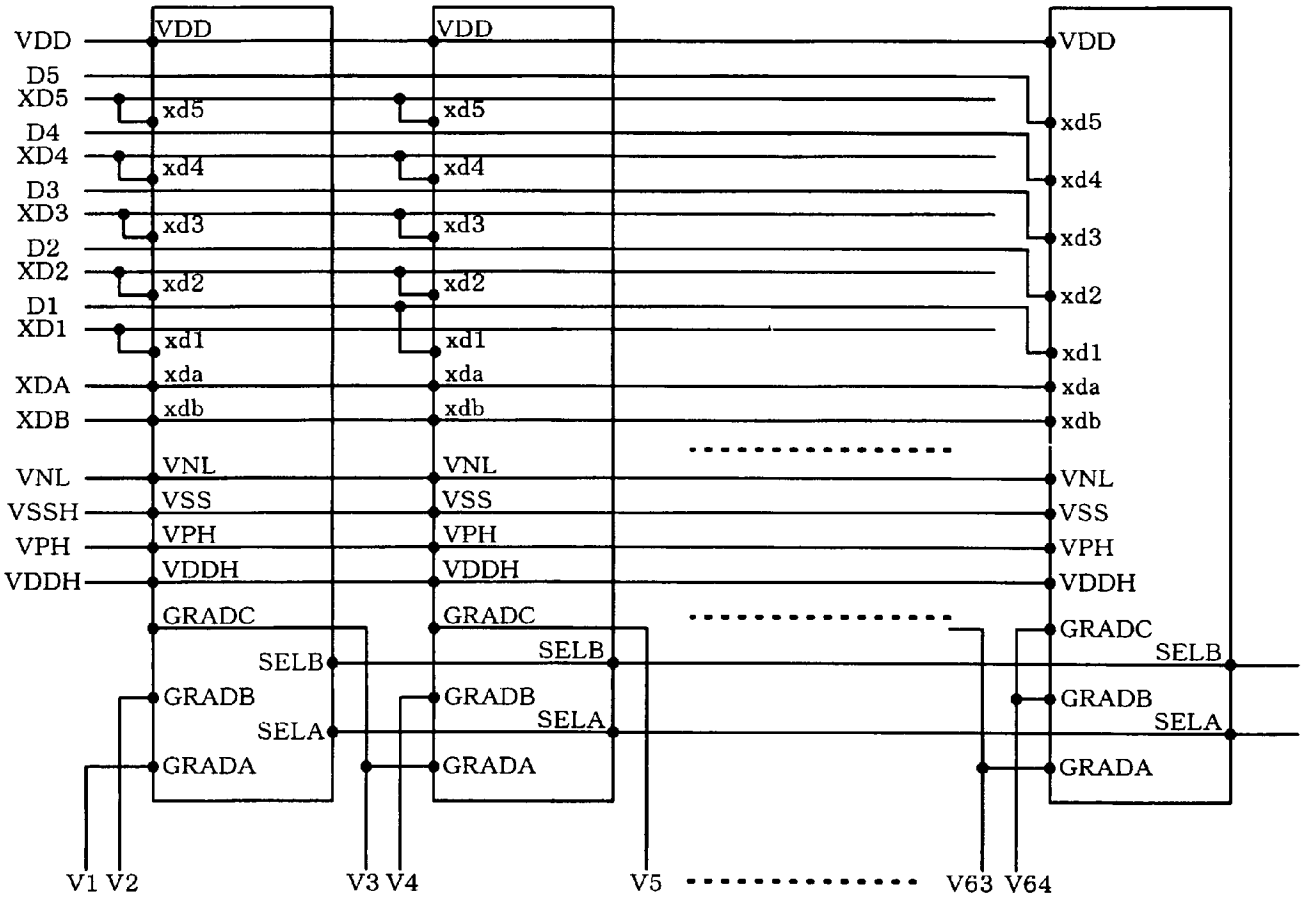
FIG. 7 is a block diagram showing a configuration example of a voltage select circuit shown in FIG. 6.

FIG. 7 is a block diagram showing a configuration example of the voltage select circuit shown in FIG. 6.

FIG. 7 shows an example in which j is 6 and k is 4. FIG. 7 shows a configuration example of the voltage select circuit $DEC_1$ among the voltage select circuits $DEC_1$ to $DEC_N$. Note that the voltage select circuits $DEC_2$ to $DEC_N$ have the same configuration as that of the voltage select circuit $DEC_1$.

The voltage select circuit $DEC_1$ has a plurality of voltage select blocks. Each voltage select block shown in FIG. 7 has an identical configuration. The voltages VDD, VNL, VSSH, VPH, and VDDH, data D5 to D1, and inversion data XD5 to XD1, XDA, and XDB are input to the voltage select blocks. The inversion data XD5 to XD1 is data obtained by reversing the 5-bit data D5 to D1 of the lower-order 6-bit data of the grayscale data excluding the least significant bit. The inversion data XDA is set at the H level when the least significant bit data D0 of the grayscale data is "1". The inversion data XDB is set at the H level when the least significant bit data D0 of the grayscale data is "0".

For example, the inversion data XD5 to XD1 is input to the voltage select block which selects two voltages from the grayscale voltages V1 to V3, the inversion data XD5 to XD2 and the data D1 are input to the voltage select block which selects two voltages from the grayscale voltages V3 to V5, and the data D5 to D1 is input to the voltage select block to which the grayscale voltages V63 and V64 are input.

The grayscale voltages V1 to V3, V3 to V5, V5 to V7, . . . among the $2^{6(=j)}$ grayscale voltages are input to the respective voltage select blocks. Each voltage select block outputs the voltages SELA and SELB from the three grayscale voltages.

Figure 8:
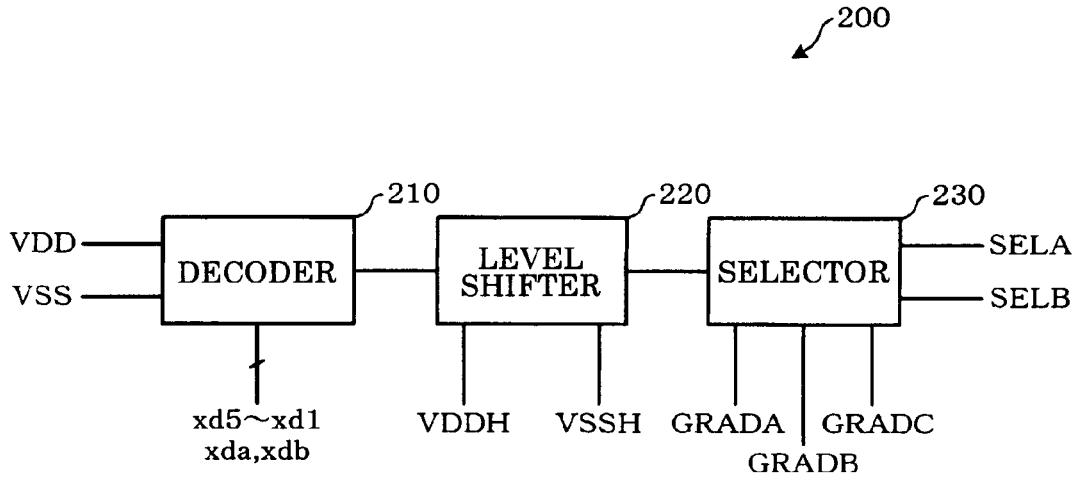
FIG. 8 is a view schematically showing a voltage select block shown in FIG. 7.

FIG. 8 shows an outline of the configuration of the voltage select block shown in FIG. 7.

A voltage select block 200 includes a decoder 210, a level shifter 220, and a selector 230. The decoder 210 generates a switch control signal based on inversion data xd5 to xd1, xda, and xdb. The level shifter 220 converts the switch control signal into a voltage level between the voltages VDDH and VSSH. The selector 230 outputs the voltages VDDH and VSSH in a potential descending order from voltages GRADA to GRADC based on the switch control signal converted by the level shifter 220.

Figure 9:
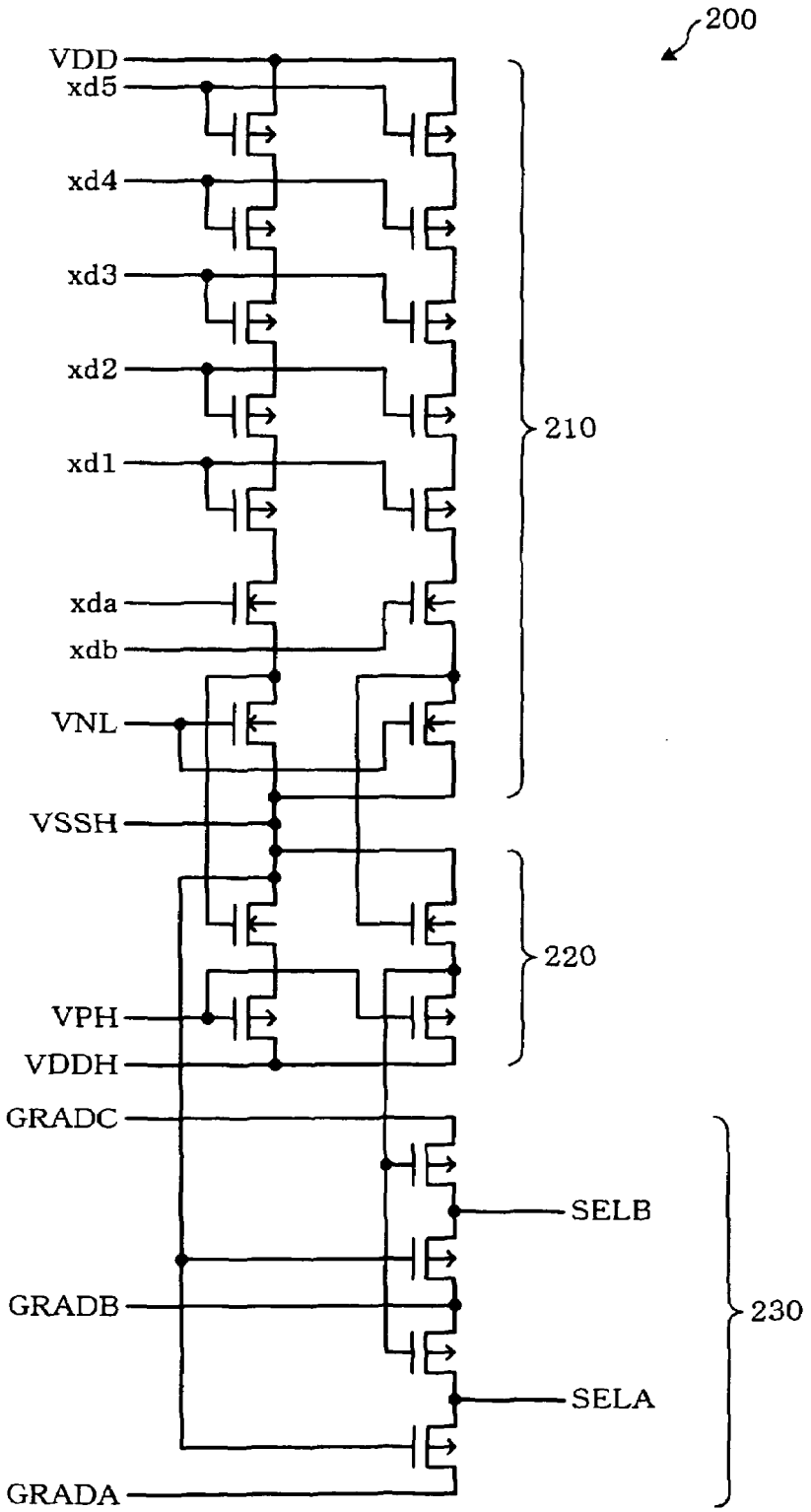
FIG. 9 is a circuit diagram showing a configuration example of the voltage select block shown in FIG. 8.

FIG. 9 is a circuit diagram showing a configuration example of the voltage select block shown in FIG. 8.

The decoder 210 includes two decoder circuits. Each of the decoder circuits includes six p-type (first conductivity type) metal oxide semiconductor (MOS) transistors connected in series. The voltage VDD is supplied to one end of each decoder circuit. An n-type (second conductivity type) MOS transistor is connected to the other end of each decoder circuit. The inversion data xd5 to xd1 and xda is supplied to the gates of the p-type MOS transistors of one of the decoder circuits, and the voltage VNL is supplied to the gate of the n-type MOS transistor. The inversion data xd5 to xd1 and xdb is supplied to the gates of the p-type MOS transistors of the other decoder circuit, and the voltage VNL is supplied to the gate of the n-type MOS transistor.

The voltage VNL is higher than the threshold voltage of the n-type MOS transistor. A drain current of the n-type MOS transistor is generated by applying the voltage VNL so that a constant current is generated between the source and the drain of each p-type MOS transistor connected in series when the inversion data xd5 to xd1 and xda is set at the L level or the inversion data xd5 to xd1 and xdb is set at the L level, whereby a signal set at the H level can be output to the level shifter 220.

The level shifter 220 is two-element level shifter. The level shifter 220 includes a p-type MOS transistor to which the voltage VPH is supplied at the gate. The voltage VPH is lower in potential than the voltage VDD by at least the threshold voltage of the p-type MOS transistor. The voltage VPH is set so that a drain current (constant current) occurs in the p-type MOS transistor. Therefore, the output of the level shifter 220 can be set at the H level when the n-type MOS transistor of the level shifter 220 is turned ON, and can be set at the L level when the n-type MOS transistor is turned OFF.

The selector 230 outputs the voltage GRADA or GRADB as the voltage SELB and outputs the voltage GRADB or GRADC as the voltage SELA based on the output from the level shifter 220.

Figure 10:
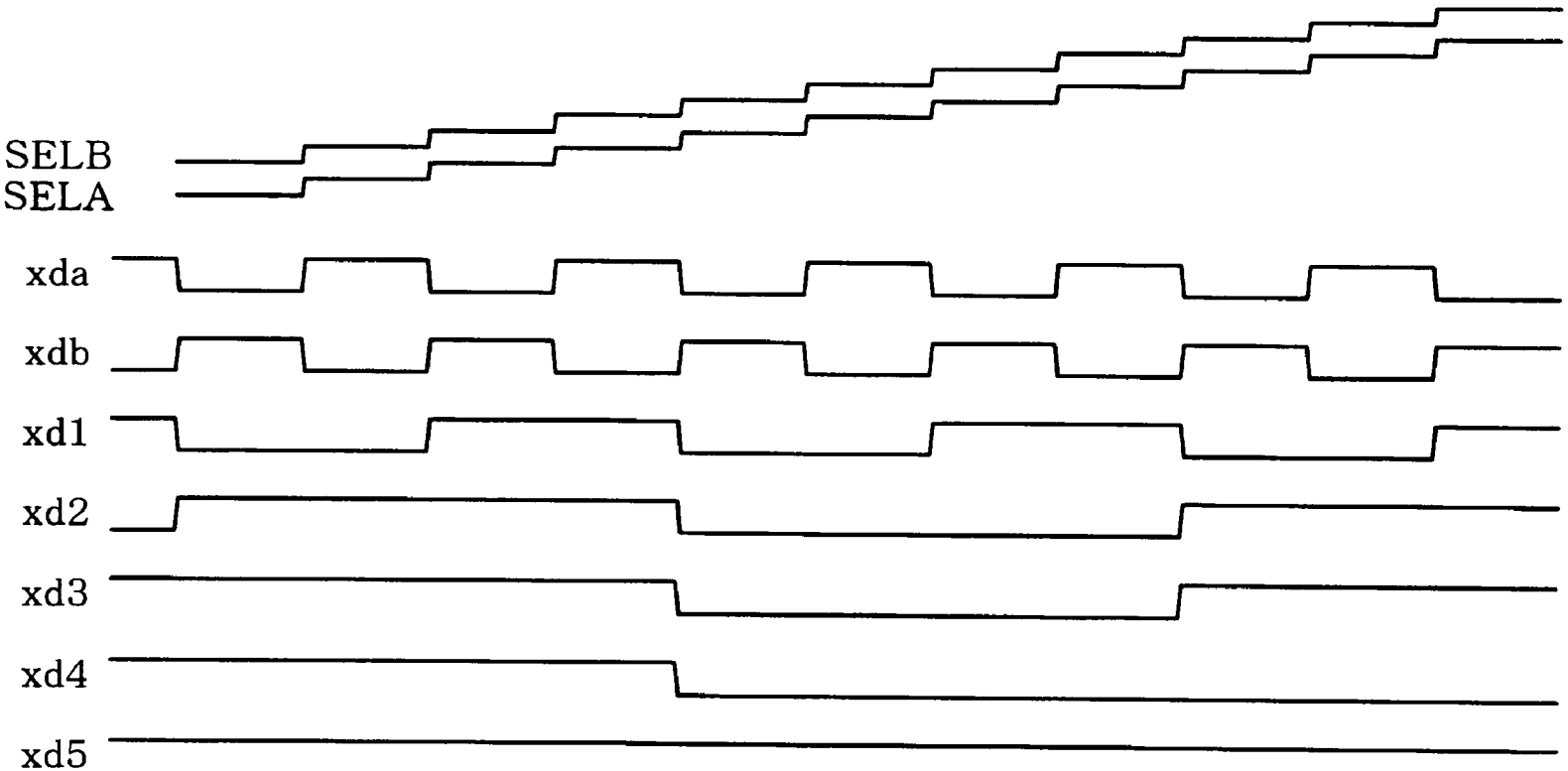
FIG. 10 is a timing diagram showing an operation example of the voltage select circuit shown in FIG. 8.

FIG. 10 is a timing diagram showing an operation example of the voltage select circuit shown in FIG. 8.

In FIG. 10, the voltages SELB and SELA are sequentially changed to the high potential side based on the inversion data xd5 to xd1, xda, and xdb. The voltages SELA and SELB have a potential difference even if the inversion data xd5 to xd1, xda, and xdb changes. In FIG. 10, the voltage select block which outputs the voltages SELA and SELB differs each time the inversion data xd5 to xd1, xda, and xdb changes.

The output circuit outputs a voltage between the voltages SELA and SELB.

Figure 11:
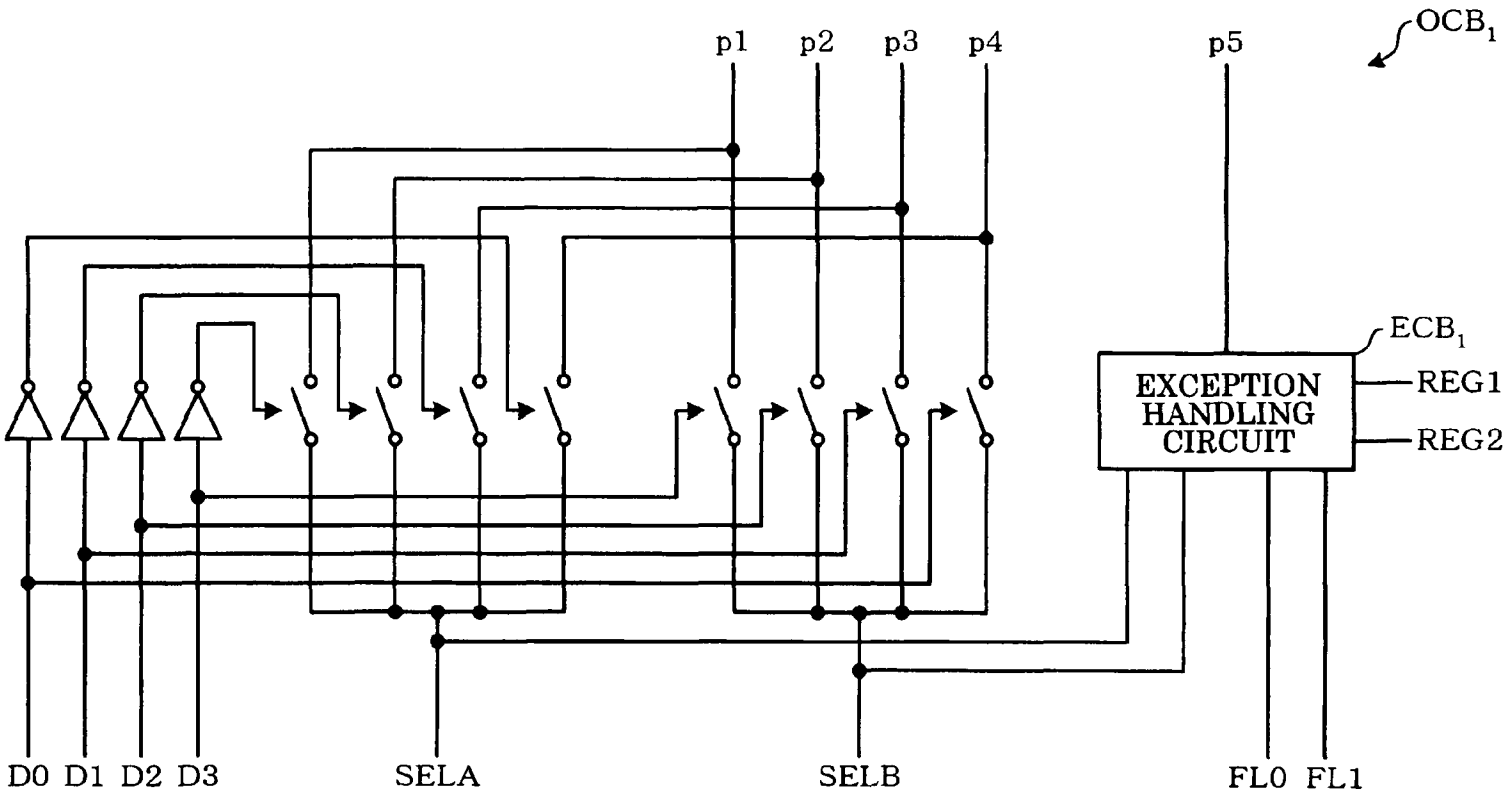
FIG. 11 is a block diagram showing a configuration example of an output control block shown in FIG. 6.

FIG. 11 is a block diagram showing a configuration example of the output control block $OCB_1$ shown in FIG. 6.

The output control block $OCB_1$ outputs control signals p1 to p4 to the output circuit $OUT_1$. The output control block $OCB_1$ outputs the voltage SELA or SELB from the voltage select circuit $DEC_1$ as the control signals p1 to p4 based on the lower-order 4 (=k) bit data D3 to D0 of the grayscale data.

The output control block $OCB_1$ may include an exception handling circuit $ECB_1$. The exception handling circuit $ECB_1$ outputs a control signal p5 which improves the grayscale characteristics corresponding to the characteristics of the LCD panel 20 to the output circuit $OUT_1$. For example, the control signal p5 from the exception handling circuit ECB1 is used for contrast adjustment aimed at black display enhancement or white display enhancement of the LCD panel 20. The source driver 30 includes a control register section provided in a control circuit (not shown), and the exception handling circuit ECB1 outputs the control signal p5 based on a value set in the control register section.

Figure 12:
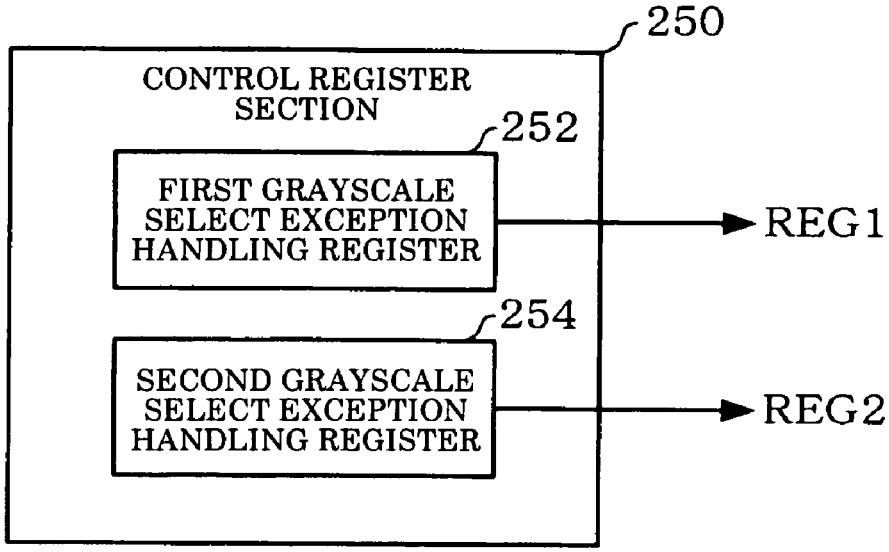
FIG. 12 is a view schematically showing the configuration of a control register section of a source driver according to one embodiment of the invention.

FIG. 12 shows an outline of the configuration of the control register section of the source driver 30 according to this embodiment.

In the configuration shown in FIG. 4, the source driver 30 includes a control register section 250 shown in FIG. 12. The control register section 250 includes a plurality of control registers. Each control register can be accessed from the display controller 38 or the host (not shown). The display controller 38 or the host sets control data (setting value) in each control register so that each section of source driver 30 performs control corresponding to the control data set in the control register.

The control register section 250 includes first and second grayscale select exception handling registers 252 and 254. The first grayscale select exception handling register 252 is a control register used to designate whether or not to perform a first exception handling process. The first exception handling process is a process which enhances grayscale representation corresponding to the high-potential-side or low-potential-side grayscale voltage. The second grayscale select exception handling register 254 is a control register used to designate whether or not to perform a second exception handling process as an exception handling process during the first exception handling process. The second exception handling process is a process which enhances grayscale representation corresponding to the grayscale voltage when all bits of the grayscale data are set at "0" or "1".

A control signal REG1 corresponding to the value set in the first grayscale select exception handling register 252 is input to the exception handling circuits of the output control blocks $OCB_1$ to $OCB_N$. A control signal REG2 corresponding to the value set in the second grayscale select exception handling register 254 is input to the exception handling circuits of the output control blocks $OCB_1$ to $OCB_N$ in the same manner as the control signal REG1.

FIGS. 13A, 13B, 14A, and 14B are views illustrative of the first exception handling process.

Figure 13A:
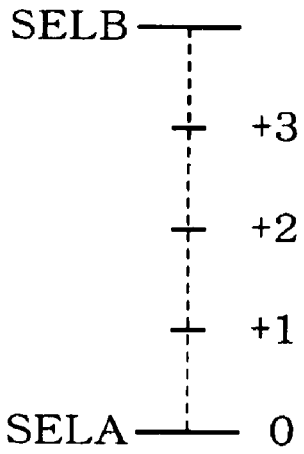
FIGS. 13A and 13B are views illustrative of a first exception handling process.
Figure 13B:
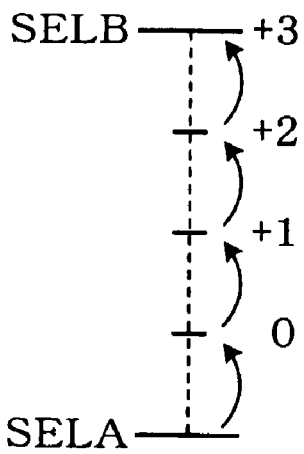
Figure 14A:
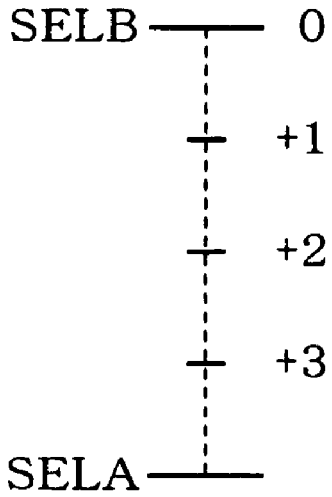
FIGS. 14A and 14B are further views illustrative of a first exception handling process.
Figure 14B:
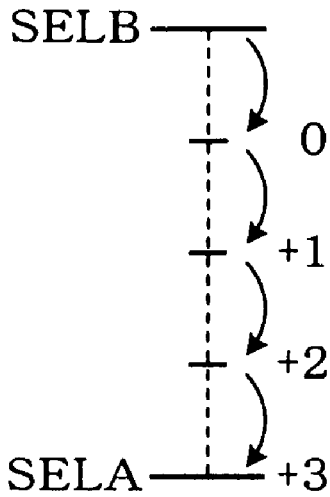

FIGS. 13A, 13B, 14A, and 14B show an example in which a voltage between the voltages SELA and SELB is divided into grayscale voltages corresponding to four consecutive grayscale values for convenience of description. FIGS. 13A and 13B are views illustrative of a positive period in which the common electrode voltage is lower than the voltage of the pixel electrode when the LCD panel 20 is subjected to polarity inversion drive. FIGS. 14A and 14B are views illustrative of a negative period in which the common electrode voltage is higher than the voltage of the pixel electrode.

FIG. 13A shows an example in which a value which designates that the first exception handling process is not performed is set in the first grayscale select exception handling register 252. FIG. 13B shows an example in which a value which designates that the first exception handling process is performed is set in the first grayscale select exception handling register 252.

In this embodiment, when the positive period occurs by subjecting the common electrode to polarity inversion drive or the common electrode voltage is fixed, and the DAC 58 outputs grayscale voltages allocated to voltages VSEL1 to VSEL ($2^k$) based on the lower-order k-bit data of the grayscale data provided that the low-potential-side voltage (low-potential-side grayscale voltage) is the voltage VSEL1, the high-potential-side voltage (high-potential-side grayscale voltage) is allocated to the voltage VSEL ($2^k$) based on the value set in the first grayscale select exception handling register 252. As shown in FIG. 13A, when the first exception handling process is not performed, four grayscale voltages are allocated between the voltages SELA and SELB. On the other hand, the grayscale voltage is not allocated to the highest-potential-side voltage SELB selected corresponding to the higher-order bits of the grayscale data. As shown in FIG. 13B, when the first exception handling process is performed, four grayscale voltages are allocated between the voltages SELA and SELB. On the other hand, the grayscale voltage is not allocated to the lowest-potential-side voltage SELA selected corresponding to the higher-order bits of the grayscale data. The above first exception handling process may be implemented by fixing the control signal p5 shown in FIG. 11 at the voltage SELB. When the first exception handling process is not performed, the control signal p5 shown in FIG. 11 is fixed at the voltage SELA, for example.

In this embodiment, when the negative period occurs by subjecting the common electrode to polarity inversion drive, and the DAC 58 outputs grayscale voltages allocated to the voltages VSEL1 to VSEL ($2^k$) based on the lower-order k-bit data of the grayscale data provided that the high-potential-side voltage (high-potential-side grayscale voltage) is the voltage VSEL1, the low-potential-side voltage (low-potential-side grayscale voltage) is allocated to the voltage VSEL ($2^k$) based on the value set in the first grayscale select exception handling register 252. As shown in FIG. 14A, when the first exception handling process is not performed, four grayscale voltages are allocated between the voltages SELA and SELB. On the other hand, the grayscale voltage is not allocated to the lowest-potential-side voltage SELA selected corresponding to the higher-order bits of the grayscale data. As shown in FIG. 14B, when the first exception handling process is performed, four grayscale voltages are allocated between the voltages SELA and SELB. On the other hand, the grayscale voltage is not allocated to the lowest-potential-side voltage SELA selected corresponding to the higher-order bits of the grayscale data. The above first exception handling process may be implemented by fixing the control signal p5 shown in FIG. 11 at the voltage SELA. When the first exception handling process is not performed, the control signal p5 shown in FIG. 11 is fixed at the voltage SELB, for example.

The above-described first exception handling process enables black display (or white display) grayscale representation to be set minutely.

FIGS. 15A to 15D, 16A, and 16B are views illustrative of the second exception handling process. FIGS. 15A to 15D, 16A, and 16B show an example in which four grayscale voltages between the high-potential-side power supply voltage VDDH and the low-potential-side power supply voltage VSSH are output for convenience of description. In this embodiment, $2^j$ grayscale voltages can be output between the voltages. FIGS. 15A to 15D, 16A, and 16B show an example in which allocation of the grayscale voltages output between the high-potential-side power supply voltage VDDH and the low-potential-side power supply voltage VSSH is changed only when all bits of the grayscale data are "0" or "1" as the second exception handling process. Note that allocation of the grayscale voltages may be changed between the voltages selected corresponding to the higher-order bits of the grayscale data only when all bits of the grayscale data are "0" or "1".

Figure 15A:
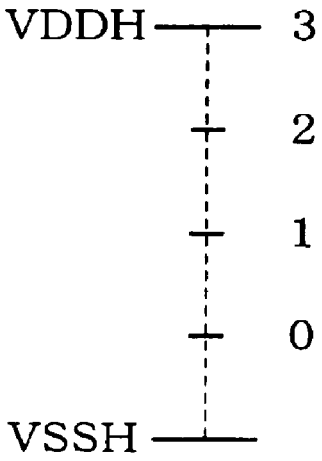
FIGS. 15A, 15B, 15C, and 15D are views illustrative of a second exception handling process.
Figure 15B:
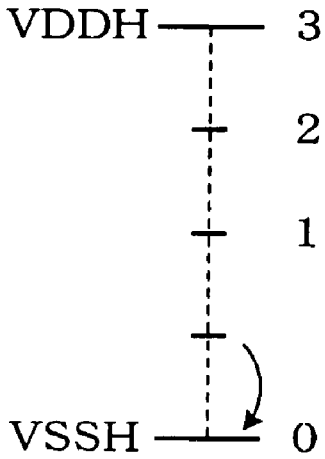
Figure 15C:
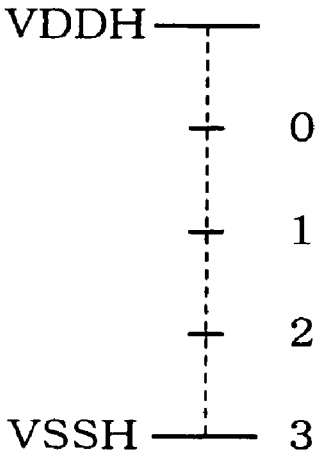
Figure 15D:
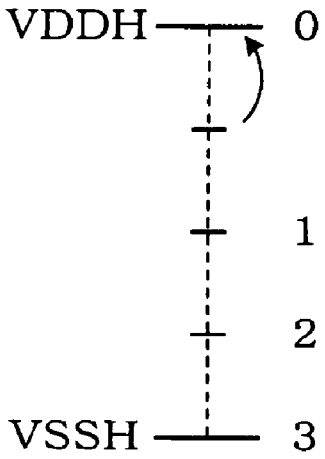

FIGS. 15A and 15C show an example in which the first exception handling process is performed and the second exception handling process is not performed. FIGS. 15B and 15D show an example in which the first exception handling process is performed and the second exception handling process is also performed. FIGS. 15C and 15D show other examples of FIGS. 15A and 15B.

In FIG. 15A, the grayscale voltage is allocated to the high-potential-side power supply voltage VDDH by the first exception handling process, for example. Therefore, the low-potential-side power supply voltage VSSH is not output as the grayscale voltage. In FIG. 15B, the grayscale voltage is allocated to the low-potential-side power supply voltage VSSH, and the high-potential-side power supply voltage VDDH is output as the grayscale voltage by performing the second exception handling process during the first exception handling process. Specifically, when the high-potential-side grayscale voltage is allocated to the voltage VSEL ($2^k$) in the first grayscale select exception handling register 252, the highest-potential grayscale voltage among the $2^j$ grayscale voltages is allocated to the high-potential-side grayscale voltage based on the value set in the second grayscale select exception handling register 254 only when all bits of the grayscale data are "0" or "1".

In FIG. 15C, the grayscale voltage is allocated to the low-potential-side power supply voltage VSSH by the first exception handling process. Therefore, the high-potential-side power supply voltage VDDH is not output as the grayscale voltage. In FIG. 15D, the grayscale voltage is allocated to the high-potential-side power supply voltage VDDH, and the low-potential-side power supply voltage VSSH is output as the grayscale voltage by performing the second exception handling process during the first exception handling process. Specifically, when the low-potential-side grayscale voltage is allocated to the voltage VSEL ($2^k$) in the first grayscale select exception handling register 252, the lowest-potential grayscale voltage among the $2^j$ grayscale voltages is allocated to the low-potential-side grayscale voltage based on the value set in the second grayscale select exception handling register 254 only when all bits of the grayscale data are "0" or "1".

In FIGS. 15B and 15D, continuity of grayscale representation may be impaired. However, the grayscale voltage can be output in the range of the power supply voltages VDDH and VSSH. In FIG. 15B, the display quality of all-white or all-black grayscale display can be improved. In FIG. 15D, all-black or all-white grayscale representation can be set minutely.

Figure 16A:
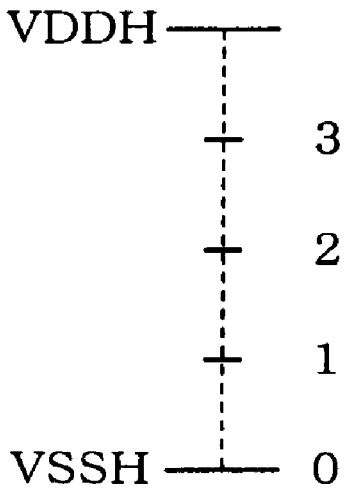
FIGS. 16A, 16B, 16C, and 16D are further views illustrative of a second exception handling process.
Figure 16B:
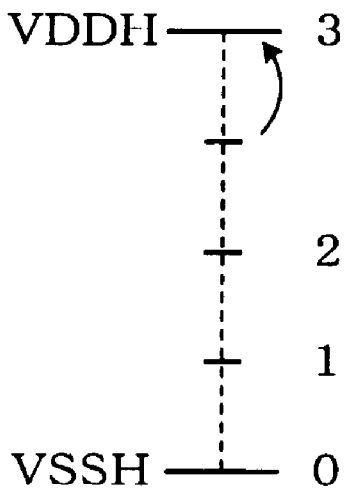
Figure 16C:
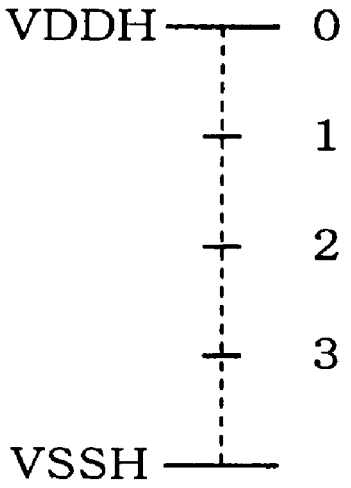
Figure 16D:
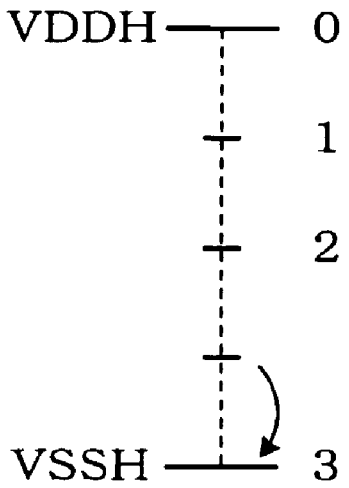

FIGS. 16A and 16C show an example in which the first exception handling process is performed and the second exception handling process is not performed. FIGS. 16B and 16D show an example in which the first exception handling process is performed and the second exception handling process is also performed. FIGS. 16C and 16D show other examples of FIGS. 16A and 16B.

In FIG. 16A, the grayscale voltage is allocated to the low-potential-side power supply voltage VSSH by the first exception handling process, for example. Therefore, the high-potential-side power supply voltage VDDH is not output as the grayscale voltage. In FIG. 16B, the grayscale voltage is allocated to the high-potential-side power supply voltage VDDH, and the low-potential-side power supply voltage VSSH is output as the grayscale voltage by performing the second exception handling process during the first exception handling process.

In FIG. 16C, the grayscale voltage is allocated to the high-potential-side power supply voltage VDDH by the first exception handling process. Therefore, the low-potential-side power supply voltage VSSH is not output as the grayscale voltage. In FIG. 16D, the grayscale voltage is allocated to the low-potential-side power supply voltage VSSH, and the high-potential-side power supply voltage VDDH is output as the grayscale voltage by performing the second exception handling process during the first exception handling process.

In FIGS. 16B and 16D, continuity of grayscale representation may be impaired. However, the grayscale voltage can be output in the range of the power supply voltages VDDH and VSSH. In FIG. 16B, the display quality of all-white or all-black grayscale display can be improved. In FIG. 16D, all-black or all-white grayscale representation can be set minutely.

Figure 17:
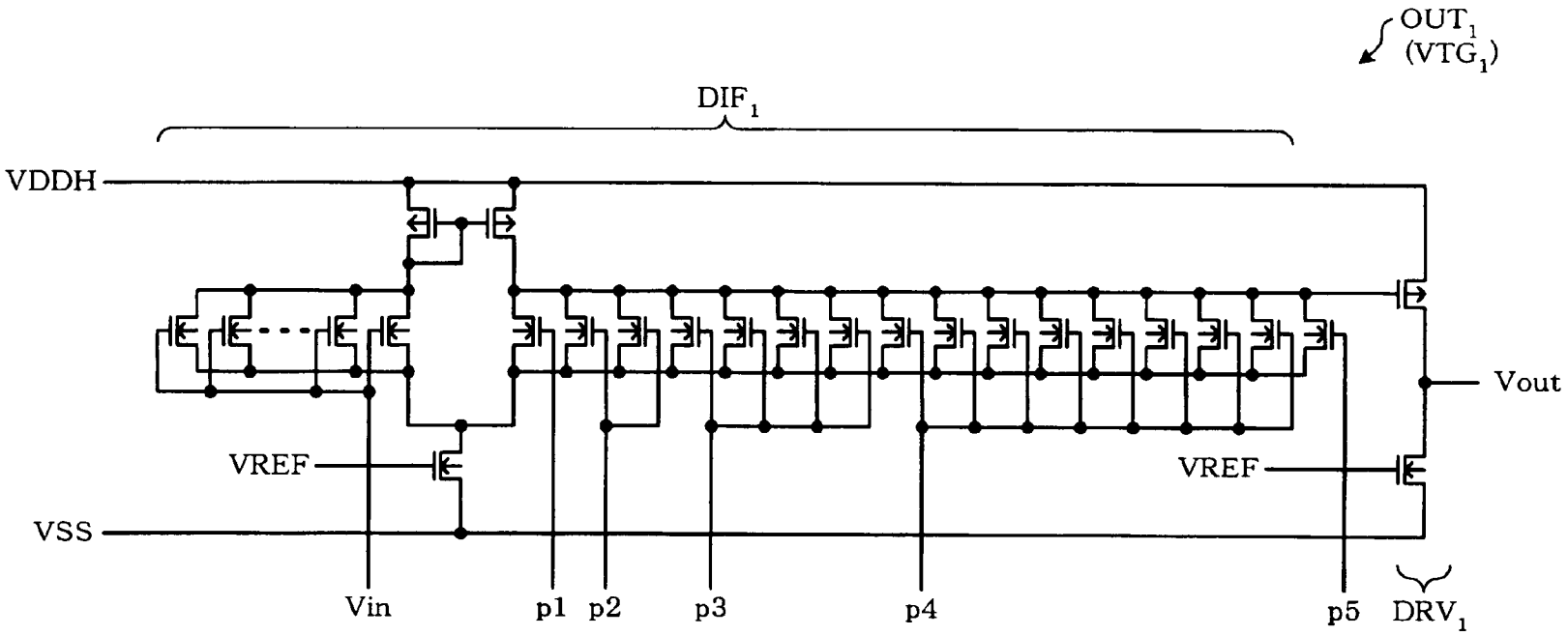
FIG. 17 is a circuit diagram of a configuration example of an output circuit shown in FIG. 6.

FIG. 17 is a circuit diagram showing a configuration example of the output circuit $OUT_1$ shown in FIG. 6.

Note that the output circuits $OUT_2$ to $OUT_N$ have the same configuration as that of the output circuit $OUT_1$ shown in FIG. 17.

The output circuit $OUT_1$ is a voltage follower circuit $VTG_1$ which includes a differential amplifier $DIF_1$ and a driver section $DRV_1$. The differential amplifier $DIF_1$ includes a differential transistor pair. The driver section $DRV_1$ drives the source line based on the output from the differential amplifier $DIF_1$. The grayscale voltage between the low-potential-side grayscale voltage and the high-potential-side grayscale voltage corresponding to the lower-order k-bit data of the grayscale data can be output to the source line by changing the current drive capability of the differential transistor pair of the differential amplifier $DIF_1$.

In FIG. 17, a second differential transistor group of first and second differential transistor groups which form the differential transistor pair of the differential amplifier $DIF_1$ includes k transistors. The signals (control signals p1 to p4 in FIG. 17) corresponding to the lower-order k-bit data of the grayscale data are supplied to the gates of the k transistors.

When performing the above-described exception handling process, an exception handling transistor to which the control signal p5 is supplied at the gate is provided in parallel with the K transistors. In this case, current drive capability when the first differential transistor group is set in a conducting state is equal to current drive capability when the second differential transistor group and the exception handling transistors are set in a conducting state. This enables the first and second exception handling processes to be implemented by a simple configuration.

When the current drive capabilities of the first and second transistor groups are equal (e.g., when the control signals p1 to p5 are set at the voltage SELB), the output circuit $OUT_1$ can output the same voltage as the input voltage. The current drive capabilities of the first and second transistor groups of the output circuit $OUT_1$ can be caused to differ by changing the conducting state of the transistors of the second transistor group. As a result, the output circuit $OUT_1$ can output a voltage differing from the voltage SELB, for example. The output circuit $OUT_1$ can output an output voltage at the voltage level between the voltages SELA and SELB by setting the voltage levels of the control signals p1 to p5 at a voltage level between the voltages SELA and SELB.

The output circuit $OUT_1$ may include a lower-order bit decoder which decodes the lower-order k-bit data of the grayscale data, each transistor of the second differential transistor group of the first and second differential transistor groups of the differential transistor pair may have an identical current drive capability, and a signal corresponding to the decoding result of the lower-order bit decoder may be supplied to the gate of each transistor. This reduces the number of transistors which form the differential transistor group.

2. Electronic Instrument

An electronic instrument to which the liquid crystal device 10 (source driver 30) according to the above embodiment is applied is described below.

2.1 Projection-Type Display Device

An electronic instrument formed using the above-described liquid crystal device 10 may be a projection-type display device.

Figure 18:
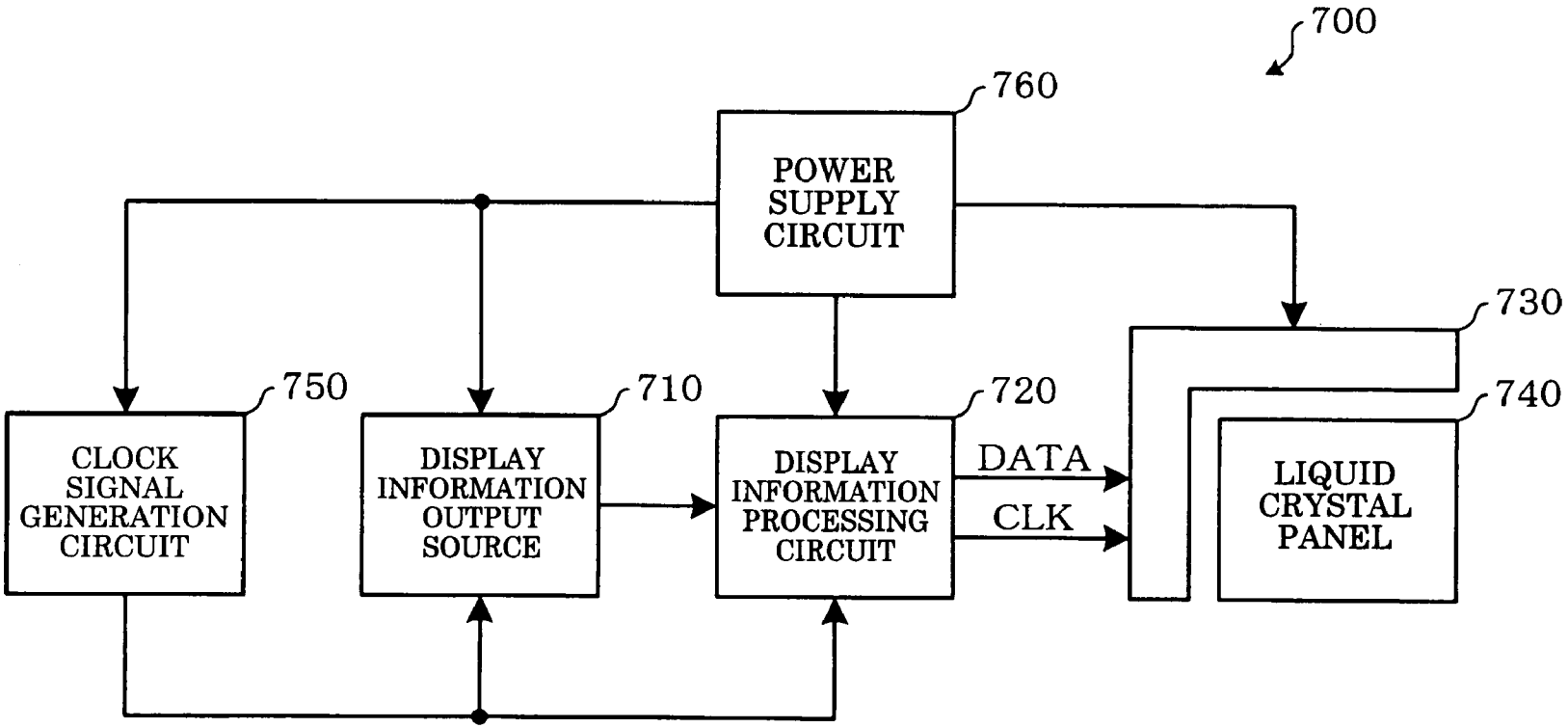
FIG. 18 is a block diagram showing a configuration example of a projection-type display device to which a liquid crystal device according to one embodiment of the invention is applied.

FIG. 18 is a block diagram showing a configuration example of a projection-type display device to which the liquid crystal device 10 according to the above embodiment is applied.

A projection-type display device 700 includes a display information output source 710, a display information processing circuit 720, a display driver circuit 730 (display driver), a liquid crystal panel 740, a clock signal generation circuit 750, and a power supply circuit 760. The display information output source 710 includes a memory such as a read only memory (ROM), a random access memory (RAM), or an optical disk device, and a tuning circuit which tunes and outputs an image signal. The display information output source 710 outputs display information (e.g., image signal in a given format) to the display information processing circuit 720 based on a clock signal from the clock signal generation circuit 750. The display information processing circuit 720 may include an amplification/polarity inversion circuit, a phase expansion circuit, a rotation circuit, a gamma correction circuit, a clamping circuit, or the like. The display driver circuit 730 includes a gate driver and a source driver, and drives the liquid crystal panel 740. The power supply circuit 760 supplies power to each circuit.

Figure 19:
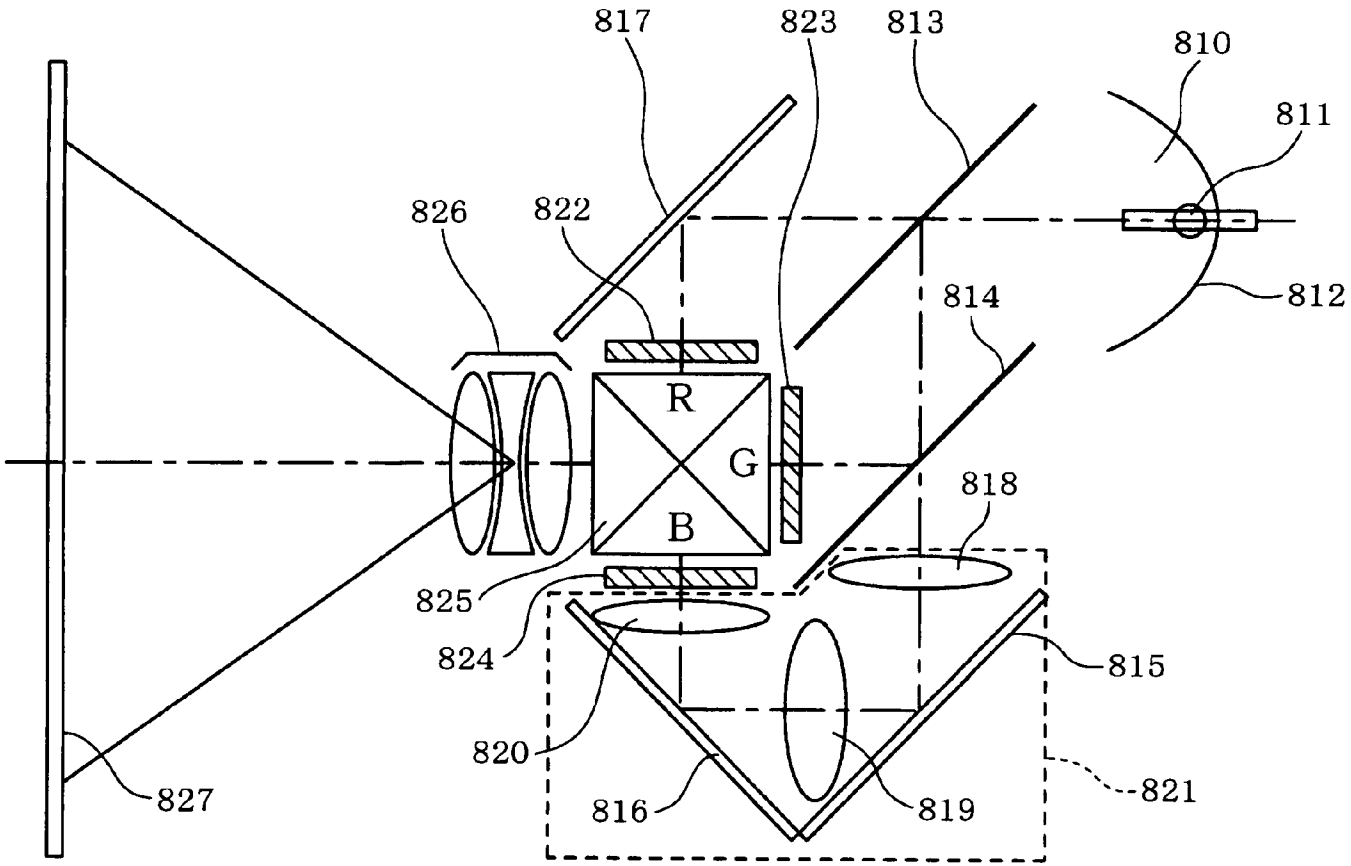
FIG. 19 is a schematic view showing the main portion of a projection-type display device.

FIG. 19 is a schematic view showing the main portion of a projection-type display device.

The projection-type display device includes a light source 810, dichroic mirrors 813 and 814, reflection mirrors 815, 816, and 817, an incident lens 818, a relay lens 819, an exit lens 820, liquid crystal light modulators 822, 823, and 824, a cross dichroic prism 825, and a projection lens 826. The light source 810 includes a lamp 811 such as a metal halide lamp, and a reflector 812 which reflects light emitted from the lamp. The dichroic mirror 813 which reflects blue light and green light allows red light contained in luminous flux from the light source 810 to pass through, and reflects blue light and green light. Red light which has passed through the dichroic mirror 813 is reflected by the reflection mirror 817 and enters the red light liquid crystal light modulator 822. Green light reflected by the dichroic mirror 813 is reflected by the dichroic mirror 814 which reflects green light, and enters the green light liquid crystal light modulator 823. Blue light also passes through the second dichroic mirror 814. A photo-conductive means 821 formed of a relay lens system including the incident lens 818, the relay lens 819, and the exit lens 820 is provided for blue light in order to prevent optical loss due to a long optical path. Blue light enters the blue light liquid crystal light modulator 824 through the photo-conductive means 821. The three color light rays modulated by each light modulator circuit enters the cross dichroic prism 825. In the cross dichroic prism 825, four rectangular prisms are bonded, and a dielectric multilayer film which reflects red light and a dielectric multilayer film which reflects blue light are formed on the inner side in the shape of a cross. The three color light rays are synthesized by the dielectric multilayer films so that light which expresses a color image is formed. The projection means of the projection-type display device is thus formed. Light synthesized by the projection means is projected onto a screen 827 by a projection lens 826 (projection optical system) so that an enlarged image is displayed.

2.2 Portable Telephone

An electronic instrument formed using the above-described liquid crystal device 10 may be a portable telephone.

Figure 20:
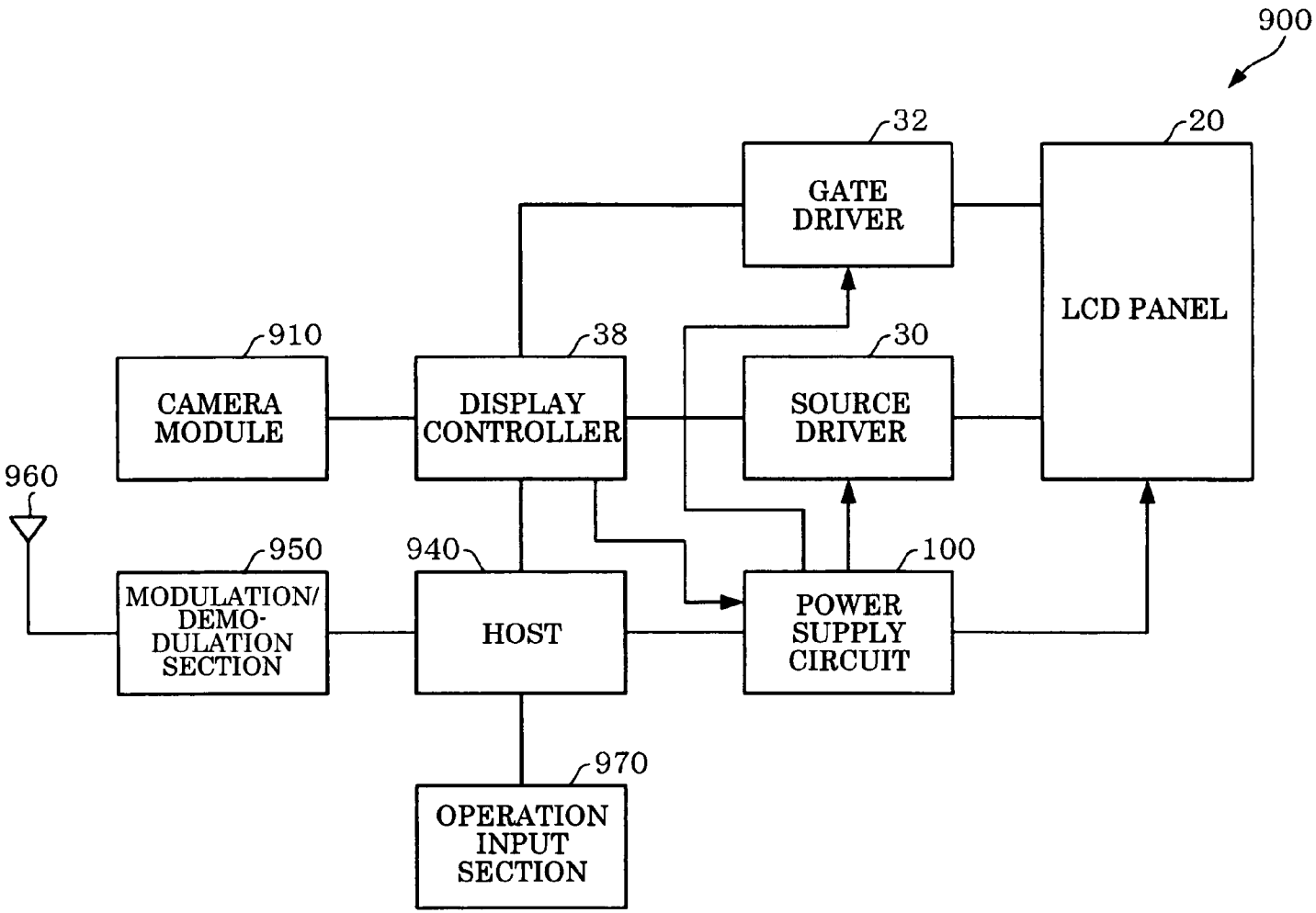
FIG. 20 is a block diagram showing a configuration example of a portable telephone to which a liquid crystal device according to one embodiment of the invention is applied.

FIG. 20 is a block diagram showing a configuration example of a portable telephone to which the liquid crystal device 10 according to the above embodiment is applied. In FIG. 20, the same sections as in FIG. 1 or 2 are indicated by the same symbols. Description of these sections is appropriately omitted.

A portable telephone 900 includes a camera module 910. The camera module 910 includes a CCD camera, and supplies data of an image captured using the CCD camera to a display controller 38 in a YUV format.

The portable telephone 900 includes an LCD panel 20. The LCD panel 20 is driven by a source driver 30 and a gate driver 32. The LCD panel 20 includes a plurality of gate lines, a plurality of source lines, and a plurality of pixels.

The display controller 38 is connected with the source driver 30 and the gate driver 32, and supplies grayscale data in an RGB format to the source driver 30.

A power supply circuit 100 is connected to the source driver 30 and the gate driver 32, and supplies drive power supply voltages to the source driver 30 and the gate driver 32. The power supply circuit 94 supplies the common electrode voltage Vcom to the common electrode of the LCD panel 20.

A host 940 is connected to the display controller 38. The host 940 controls the display controller 38. The host 940 demodulates grayscale data received through an antenna 960 using a modulator-demodulator section 950, and supplies the demodulated grayscale data to the display controller 38. The display controller 38 causes the source driver 30 and the gate driver 32 to display an image on the LCD panel 20 based on the grayscale data.

The host 940 modulates grayscale data generated by the camera module 910 using the modulator-demodulator section 950, and directs transmission of the modulated data to another communication device via the antenna 960.

The host 940 transmits and receives grayscale data, captures an image using the camera module 910, and displays an image on the LCD panel 20 based on operation information from an operation input section 970.

In FIG. 20, the host 940 or the display controller 38 may be referred to as a means that supplies the grayscale data.

The invention is not limited to the above embodiments. Various modifications and variations may be made within the spirit and scope of the invention. For example, the invention may be applied not only to drive the above-described liquid crystal display panel, but also to drive an electroluminescent display device, a plasma display device, and the like.

Some of the requirements of any claim of the invention may be omitted from a dependent claim which depends on that claim. Some of the requirements of any independent claim of the invention may be allowed to depend on any other independent claim.

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention.

What is claimed is:

1. A source driver that drives a source line of an electro-optical device based on (j+k)-bit grayscale data, j being a natural number, k being a natural number, the source driver comprising:

$2^j$ grayscale voltage lines;

a grayscale voltage select circuit that outputs two grayscale voltages based on higher-order j-bit data among $2^j$ grayscale voltages supplied through the $2^j$ grayscale voltage lines, the two grayscale voltages including a low-potential-side grayscale voltage and a high-potential-side grayscale voltage; and a source line driver circuit having a voltage follower circuit, the voltage follower circuit including a differential amplifier having a differential transistor pair, and a driver section driving the source line based on an output from the differential amplifier;

the differential transistor pair including a first differential transistor group and a second differential transistor group, the second differential transistor group including first to k transistor groups, each group of the first to k transistor groups including $2^{K-1}$ transistors, the source line driver circuit outputting a grayscale voltage corresponding to lower-order k-bit data between the low-potential-side grayscale voltage and the high-potential-side grayscale voltage to the source line by supplying a corresponding signal of one-bit data among the lower-order k-bit data to a gate of a corresponding transistor in a corresponding transistor group among the first to k transistor groups, the corresponding signal being set to be either one of the low-potential-side grayscale voltage and the high-potential-side grayscale voltage.

2. The source driver as defined in claim 1, further comprising:

a first grayscale select exception handling register, when the grayscale voltage select circuit outputs grayscale voltages that are allocated to voltages VSEL1 to VSEL ($2^k$) based on the lower-order k-bit data provided that the low-potential-side grayscale voltage is the voltage VSEL1 and the voltages VSEL1 to VSEL ($2^k$) are orderly allocated toward a high voltage side, the high-potential-side grayscale voltage being allocated to the voltage VSEL ($2^k$) based on a value set in the first grayscale select exception handling register.

3. The source driver as defined in claim 2, further comprising:

a second grayscale select exception handling register, when the high-potential-side grayscale voltage is allocated to the voltage VSEL ($2^k$) by the first grayscale select exception handling register, a highest-potential grayscale voltage among the $2^j$ grayscale voltages being allocated to the high-potential-side grayscale voltage based on a value set in the second grayscale select exception handling register only when all bits of the grayscale data are "0" or only when all bits of the grayscale data are "1".

4. The source driver as defined in claim 1, further comprising:

a first grayscale select exception handling register, when the grayscale voltage select circuit outputs grayscale voltages that are allocated to voltages VSEL1 to VSEL ($2^k$) based on the lower-order k-bit data provided that the high-potential-side grayscale voltage is the voltage VSEL1 and the voltages VSEL1 to VSEL ($2^k$) are orderly allocated toward a low voltage side, the low-potential-side grayscale voltage being allocated to the voltage VSEL ($2^k$) based on a value set in the first grayscale select exception handling register.

5. The source driver as defined in claim 4, further comprising:

a second grayscale select exception handling register, when the low-potential-side grayscale voltage is allocated to the voltage VSEL ($2^k$) by the first grayscale select exception handling register, a lowest-potential grayscale voltage among the $2^j$ grayscale voltages being allocated to the low-potential-side grayscale voltage based on a value set in the second grayscale select exception handling register only when all bits of the grayscale data are "0" or only when all bits of the grayscale data are "1".

6. An electro-optical device comprising:

a plurality of gate lines;

a plurality of source lines;

a plurality of pixels, each of the plurality of pixels being specified by a gate line among the plurality of gate lines and a source line among the plurality of source lines; and the source driver as defined in claim 1 that drives the plurality of source lines.

7. The electro-optical device as defined in claim 6, further comprising:

a gate line driver that scans the plurality of gate lines.

8. An electro-optical device comprising the source driver as defined in claim 1.

9. A projection-type display device comprising:

the electro-optical device as defined in claim 6;

a light source that emits light that enters the electro-optical device; and a projection device that projects light emitted from the electro-optical device.

10. A projection-type display device comprising the source driver as defined in claim 1.

11. An electronic instrument comprising the electro-optical device as defined in claim 6.

12. An electronic instrument comprising:

the electro-optical device as defined in claim 6; and a device that supplies grayscale data to the electro-optical device.

13. An electronic instrument comprising the source driver as defined in claim 1.

* * * * *